US012767198B2

(12) United States Patent
Dreasher

(10) Patent No.: US 12,767,198 B2
(45) Date of Patent: Oct. 20, 2026

(54) SYSTEM AND METHOD FOR INFERRING VEHICLE ROUTE SWITCH STATUS

(71) Applicant: Transportation IP Holdings, LLC, Norwalk, CT (US)

(72) Inventor: Rebecca Wilson Dreasher, Longmont, CO (US)

(73) Assignee: Transportation IP Holdings, LLC, Norwalk, CT (US)

( * ) Notice: Subject to any disclaimer, the term of this patent is extended or adjusted under 35 U.S.C. 154(b) by 22 days.

(21) Appl. No.: 19/081,364

(22) Filed: Mar. 17, 2025

(65) Prior Publication Data

US 2026/0274315 A1 Sep. 17, 2026

(51) Int. Cl.
*B61L 27/70* (2022.01)
*B61L 15/00* (2006.01)

(52) U.S. Cl.
CPC ..... *B61L 27/70* (2022.01); *B61L 15/0027* (2013.01); *B61L 15/0072* (2013.01)

(58) Field of Classification Search
CPC ... B61L 27/70; B61L 15/0027; B61L 15/0072
See application file for complete search history.

(56) References Cited

U.S. PATENT DOCUMENTS

| | | | | |
|---|---|---|---|---|
| 7,416,159 | B2 * | 8/2008 | Beaman | B61L 5/067 246/219 |
| 8,478,463 | B2 * | 7/2013 | Knott | B61L 3/221 246/177 |
| 11,543,243 | B2 * | 1/2023 | Panuski | B61L 5/1872 |
| 2018/0170415 | A1 * | 6/2018 | Oswald | B61L 25/023 |
| 2018/0222505 | A1 * | 8/2018 | Chung | B61L 15/0027 |
| 2020/0017131 | A1 * | 1/2020 | Houghton | B61L 27/70 |
| 2020/0399836 | A1 * | 12/2020 | Zampini | B61L 5/10 |
| 2023/0117899 | A1 * | 4/2023 | Vrba | B61L 15/0027 701/2 |
| 2024/0140508 | A1 * | 5/2024 | Kernwein | G08G 1/07 |

* cited by examiner

*Primary Examiner* — Sizo B Vilakazi
(74) *Attorney, Agent, or Firm* — K&L Gates LLP

(57) ABSTRACT

A system and a method for inferring status of switches positioned along a route traveled by a vehicle system are recited. A switch indicator is to emit a first signal in response to each of the switches being in its alignment configuration. The first signal emitted from the switch indicator is received in response to the vehicle system traveling toward the switch indicator before arriving at an outmost switch. That each of the switches is in its alignment configuration is determined based on a clustered first group in response to receiving the first signal.

29 Claims, 15 Drawing Sheets

SYSTEM AND METHOD FOR INFERRING VEHICLE ROUTE SWITCH STATUS

BACKGROUND

Technical Field

This disclosure pertains to systems and methods for managing vehicle movement, with a particular focus on inferring the status of switches located along routes traveled by vehicle systems.

Discussion of Art

Switches on mainline tracks are crucial for directing train movement but are often not monitored by train control systems (e.g., Positive Train Control systems). Train control systems are vital for preventing train-to-train collisions, over-speed derailments, unauthorized work zone entries, and incorrect switch operations. The lack of monitoring can lead to frequent and unnecessary stops for trains due to unknown switch statuses, disrupting schedules and increasing operational costs. Implementing comprehensive train control systems to monitor these switches is both complex and expensive. Therefore, developing innovative methods to infer switch statuses can significantly reduce the need for extensive train control systems installations, minimizing complexity and expense while maintaining safety and efficiency.

BRIEF DESCRIPTION

In one embodiment, a system for inferring status of switches positioned along a route traveled by a vehicle system includes a control circuit. The control circuit associates a plurality of switches deployed sequentially along a route with a first switch indicator deployed along the route and located subsequent to or prior to the plurality of switches such that the first switch indicator is to emit a first signal in response to each of the plurality of switches being in its alignment configuration of aligning with the route and a second signal in response to at least one of the plurality of switches being in its divergence configuration of diverging from the route. The control circuit clusters the first switch indicator that emits the first signal and the plurality of switches that each is in its alignment configuration into a first group. The control circuit clusters the first switch indicator that emits the second signal and the plurality of switches that one or more thereof is in its divergence configuration into a second group. The control circuit receives the first signal or the second signal emitted from the first switch indicator in response to the vehicle system traveling along the route in a first moving direction toward the first switch indicator and then the plurality of switches before arriving at a first outmost switch among the plurality of switches. The control circuit determines that each of the plurality of switches is in its alignment configuration based on the clustered first group in response to receiving the first signal. The control circuit determines that at least one switch among the plurality of switches is in its divergence configuration based on the clustered second group in response to receiving the second signal. The control circuit controls movement of the vehicle system in response to a determination that the plurality of switches each is in its alignment configuration or that the at least one switch is in its divergence configuration.

In one embodiment, a method for inferring status of switches positioned along a route traveled by a vehicle system includes associating a plurality of switches deployed sequentially along a route with a first switch indicator deployed along the route and located subsequent to or prior to the plurality of switches such that the first switch indicator is to emit a first signal in response to each of the plurality of switches being in its alignment configuration of aligning with the route and a second signal in response to at least one switch among the plurality of switches being in its divergence configuration of diverging from the route. The method includes clustering the first switch indicator that emits the first signal and the plurality of switches that each is in its alignment configuration into a first group. The method includes clustering the first switch indicator that emits the second signal and the plurality of switches that one or more thereof is in its divergence configuration into a second group. The method includes receiving the first signal or the second signal emitted from the first switch indicator in response to the vehicle system traveling along the route in a first moving direction toward the first switch indicator and then the plurality of switches before arriving at a first outmost switch among the plurality of switches. The method includes determining that each of the plurality of switches is in its alignment configuration based on the clustered first group in response to receiving the first signal. The method includes determining that at least one switch is in its divergence configuration based on the clustered second group in response to receiving the second signal. The method includes controlling movement of the vehicle system in response to a determination that the plurality of switches each is in its alignment configuration or that the at least one switch is in its divergence configuration.

In one embodiment, a system for inferring status of switches positioned along a route traveled by a vehicle system includes a control circuit. The control circuit associates a plurality of switches deployed sequentially along a route with a first switch indicator deployed along the route and located subsequent to or prior to the plurality of switches such that the first switch indicator is to emit a first signal in response to each of the plurality of switches being in its alignment configuration of aligning with the route. The control circuit clusters the first switch indicator that emits the first signal and the plurality of switches that each is in its alignment configuration into a first group. The control circuit determines that each of the plurality of switches is in its alignment configuration based on the clustered first group in response to receiving the first signal emitted from the first switch indicator in response to the vehicle system traveling along the route in a moving direction toward the first switch indicator and then the plurality of switches before arriving at a first outmost switch among the plurality of switches. The control circuit controls movement of the vehicle system in response to a determination that the plurality of switches each is in its alignment configuration.

DETAILED DESCRIPTION

Figure 1:
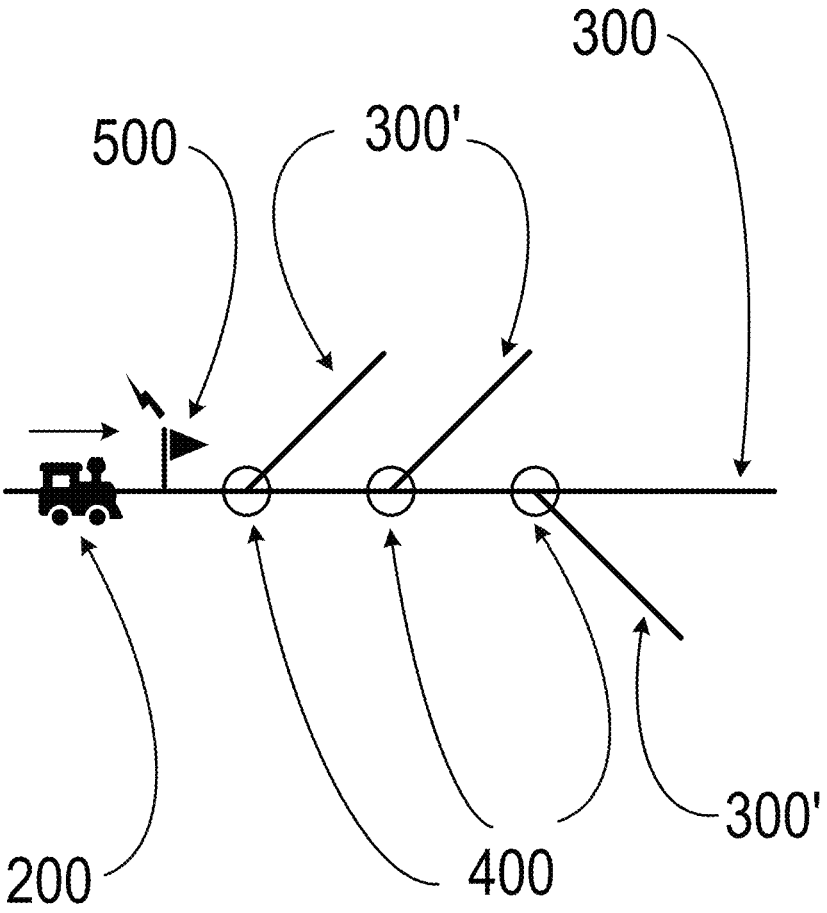
FIG. 1 illustrates a schematic diagram of a switch indicator and switches relative to a vehicle system traveling along a route according to one embodiment.
Figure 2:
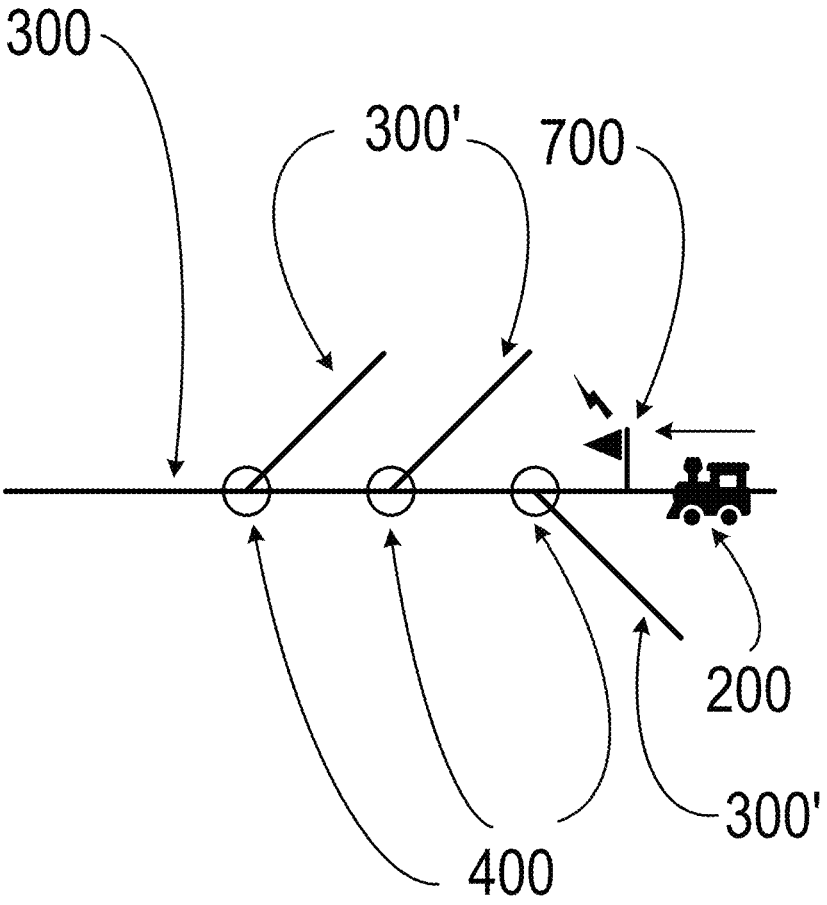
FIG. 2 illustrates a schematic diagram of a switch indicator and switches relative to a vehicle system traveling along a route according to one embodiment.

Reference will now be made in detail to the embodiments consistent with the invention, examples of which are illustrated in the accompanying drawings. Wherever possible, the same reference numerals used throughout the drawings refer to the same or like parts.

Exemplary embodiments of the invention solve the problems in the art via a system, a method, and a control circuit readable storage device for inferring status of switches positioned along a route traveled by a vehicle system.

Figure 11:
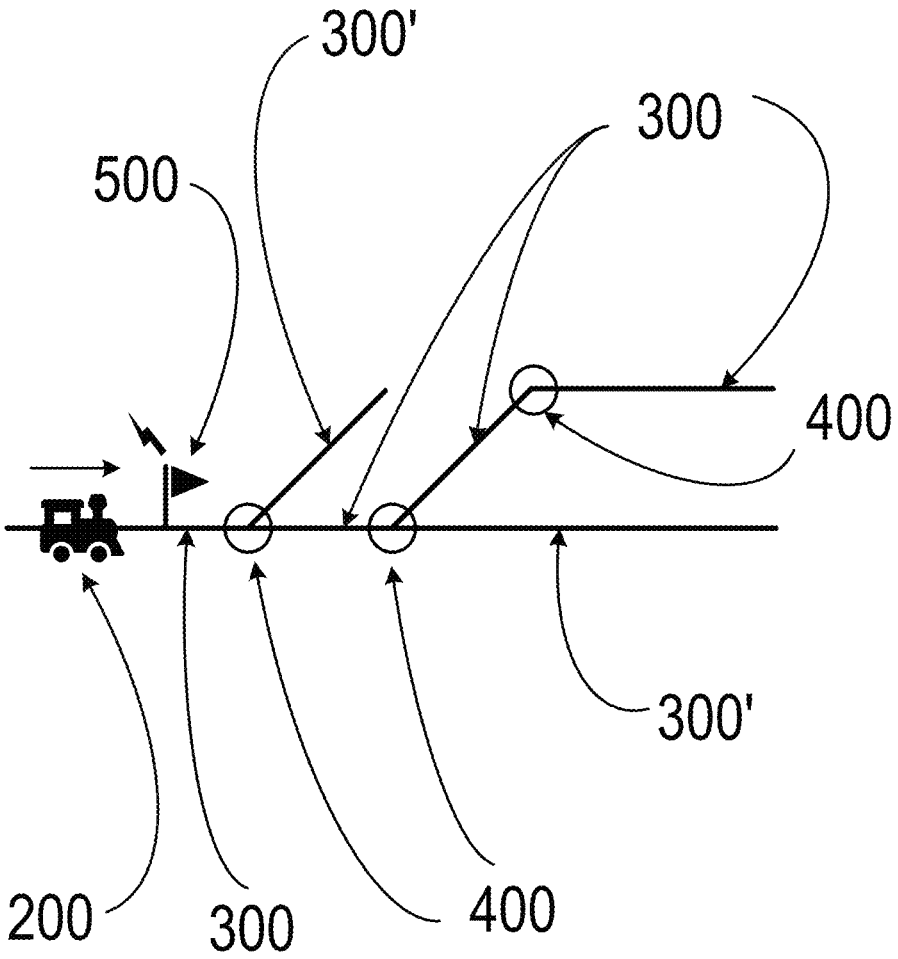
FIG. 11 illustrates a schematic diagram of a switch indicator and switches relative to a vehicle system traveling along a route that is not straight according to one embodiment.

Referring to FIG. 1, multiple switches 400 are sequentially deployed along a route 300, which is traversed by vehicle system 200. Each switch can be in either an alignment or divergence configuration. A switch is in its alignment configuration when positioned in a "normal" status, allowing the vehicle to continue along the main route without diversion. Conversely, in its divergence configuration, the switch is in a "reverse" status, directing the vehicle onto a diverging route 300' that intersects the main route. Alternatively, the alignment configuration of a switch corresponds to the reverse status, while the divergence configuration of that switch corresponds to the normal status. As shown in FIG. 1, the route 300 is illustrated as being straight; however, the route 300 does not have to be straight in reality; as shown in FIG. 11, it may be curved, or zigzag, or any line shape.

Figure 3:
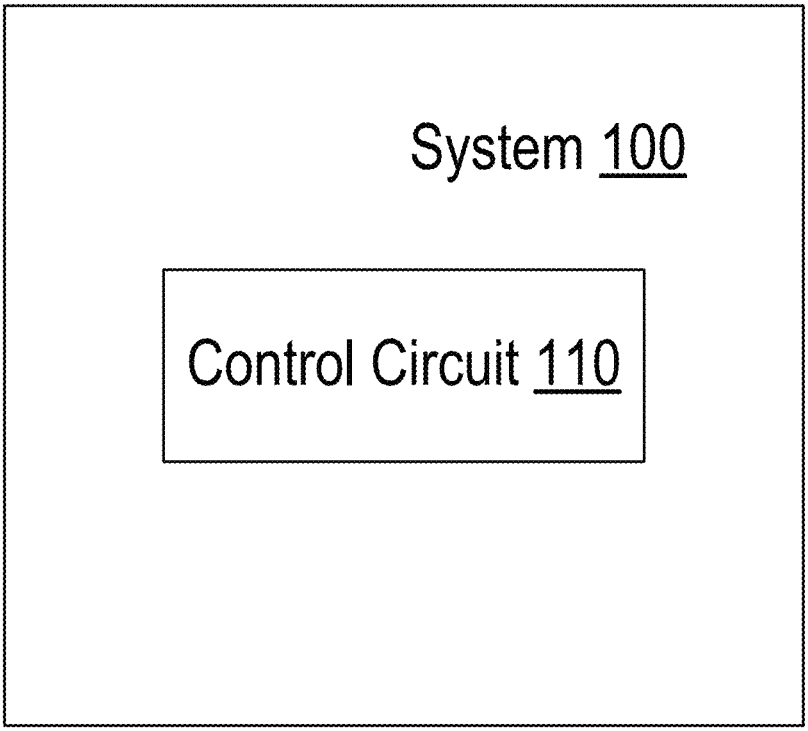
FIG. 3 illustrates a schematic diagram of a system according to one embodiment.
Figure 6:
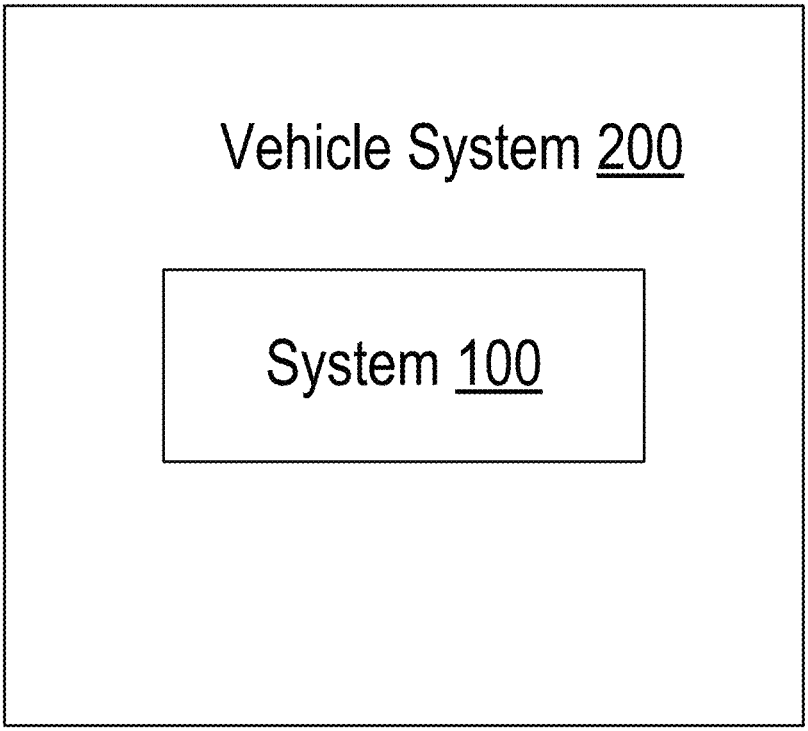
FIG. 6 illustrates a schematic diagram of a system in a vehicle system according to one embodiment.
Figure 7:
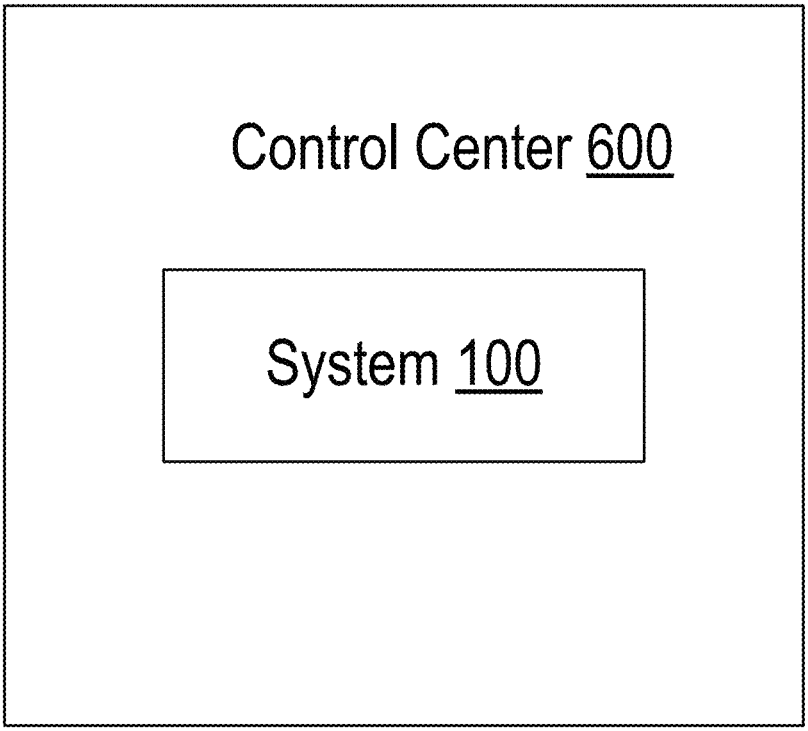
FIG. 7 illustrates a schematic diagram of a system at a control center according to one embodiment.

Referring to FIG. 3, a system 100 includes a control circuit 110 that infers status of the switches positioned along the route traveled by the vehicle system. The system may be located either onboard the vehicle system (FIG. 6) or at a remote-control center or facility 600 (FIG. 7). The system can be operated by personnel or automated through a computer, providing flexibility in monitoring and managing switch configurations.

In one embodiment, a first switch indicator 500 is positioned along the route, either on or beside it, and can be located before or after the switches. The first switch indicator is located adjacent to an outmost switch, for instance, the most left switch. The switches are electrically coupled with the first switch indicator.

Figure 9A:
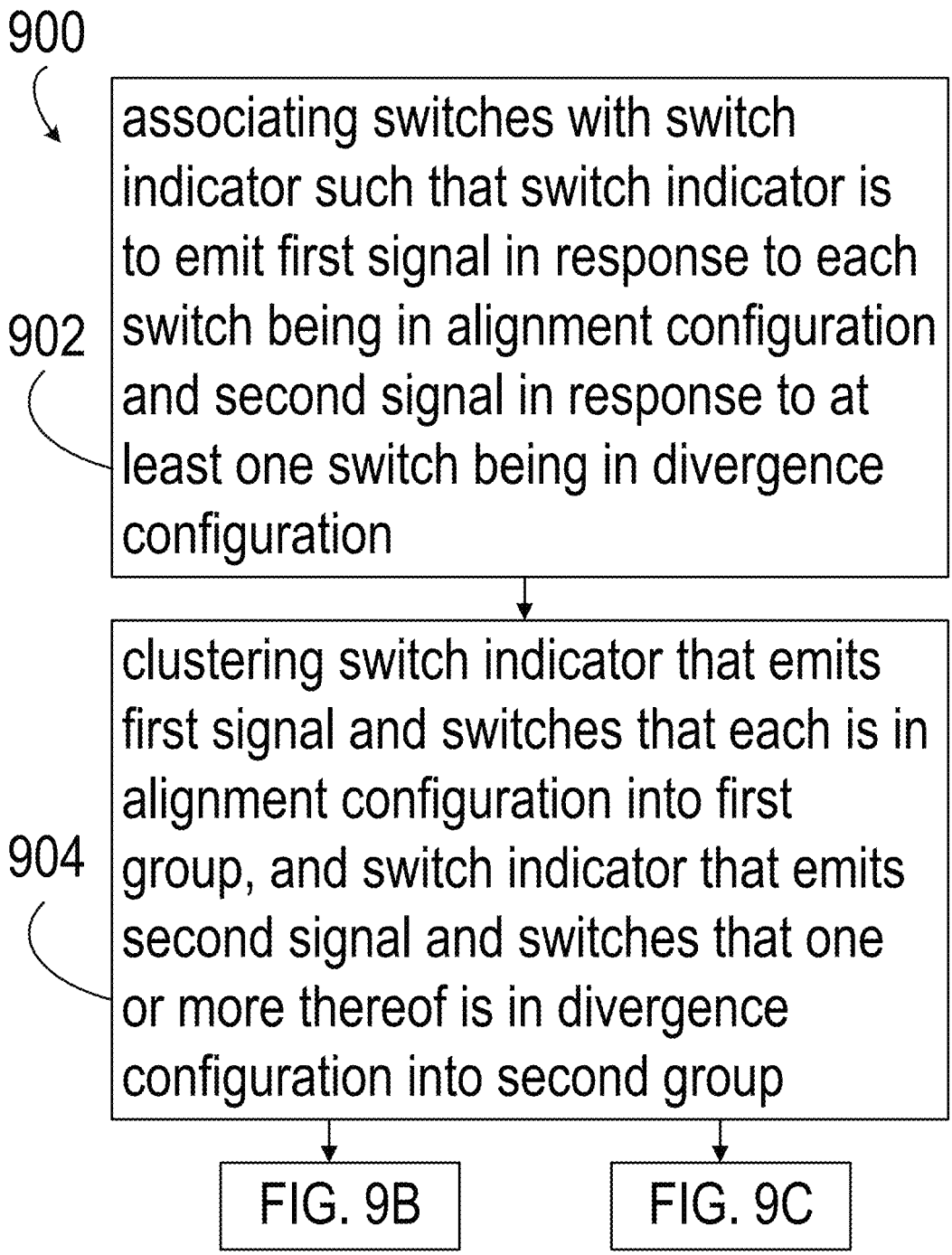
FIG. 9A illustrates a logic diagram of a method according to one embodiment.

Referring to FIGS. 9A-9C, and 10A-10C, the control circuit that executes a method 900 (FIGS. 9A-9C), 1000 (FIGS. 10A-10C) associates 902, 1002 switches and indicators into distinct groups based on their configurations. In one embodiment, as shown in FIG. 9A, the control circuit generates a first group that clusters 904 a first signal of the first switch indicator and the switches with all the switches in the alignment configuration and a second group that clusters a second signal of the first switch indicator and the switches with one or more switches in the divergence configuration. Accordingly, if the first switch indicator emits the first signal, e.g., a green light signal, the control circuit selects the first group based on the first signal and, alternatively, if the first switch indicator emits the second signal, e.g., a red light signal, the control circuit selects the second group based on the second signal. The green or red light is just for illustrated purposes; other colors might be used, such white or amber or any other available color. In other words, in the first group, the first switch indicator is deemed as having emitted the first signal, and each of the switches is deemed as having been in its alignment configuration, while in the clustered second group, the first switch indicator is deemed as having emitted the second signal, and the one or more switches is deemed as having been in its divergence configuration. The control circuit may then determine that the switches are all in the alignment configuration based on detecting the first signal or receiving an input indicative of the first signal. Conversely, control circuit determines that at least one of the switches is in the divergence configuration based on detecting the second signal or receiving an input indicative of the second signal.

In one embodiment, the control circuit receives and identifies 906 the first signal (FIG. 9B) or receives and identifies 906' the second signal (FIG. 9C) emitted from the first switch indicator in response to the vehicle system traveling along the route in a first moving direction, such as, but not limited to, from left to right, or from west to east, in FIG. 1, toward the first switch indicator and then the switches before arriving at a first outmost switch, such as the most left switch, among the switches. The first switch indicator is termed as a distant switch indicator, as being separate from the switch in a distance. In other words, when the vehicle system travels along the route in the first moving direction, and travels toward the first switch indicator and then the switches, the control circuit receives and identifies the first signal or the second signal emitted from the first switch indicator, before the vehicle system arrives at the first outmost switch, as shown in FIG. 1. The signal may be, but not limited to, audio, video, speech, image, light, electric, electromagnetic wave, sonar, and radar signal.

Figure 9B:
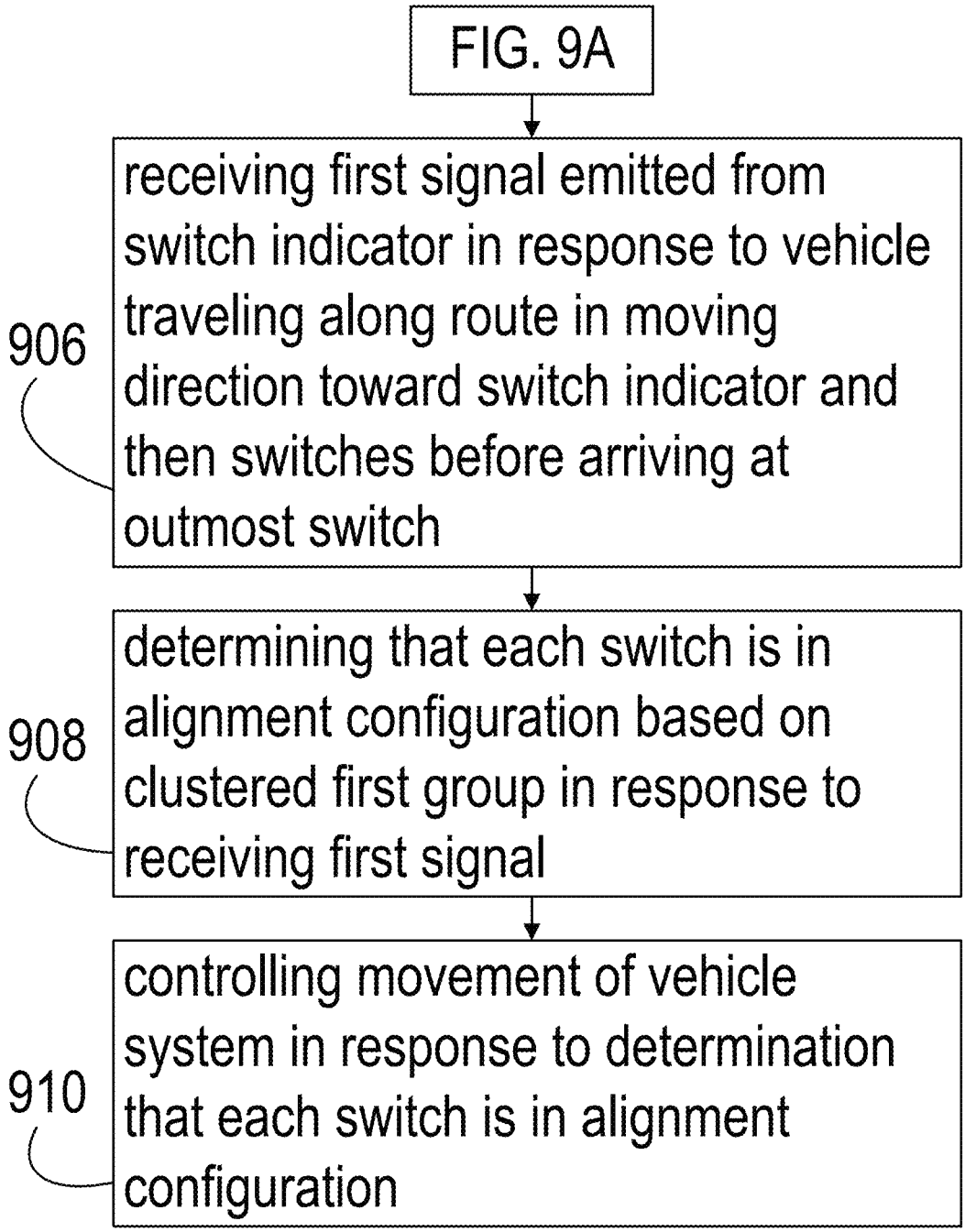
FIG. 9B illustrates a logic diagram of a method according to one embodiment.

In one embodiment, as shown in FIG. 9B, the control circuit determines 908 that each of the switches is in its alignment configuration based on the clustered first group in response to receiving the first signal. When the control circuit receives and identifies the first signal emitted from the first switch indicator, the control circuit determines that each of the switches is in its alignment configuration, as according to the clustered first group, when the first switch indicator emits the first signal, each of the switches is in its alignment configuration.

Figure 9C:
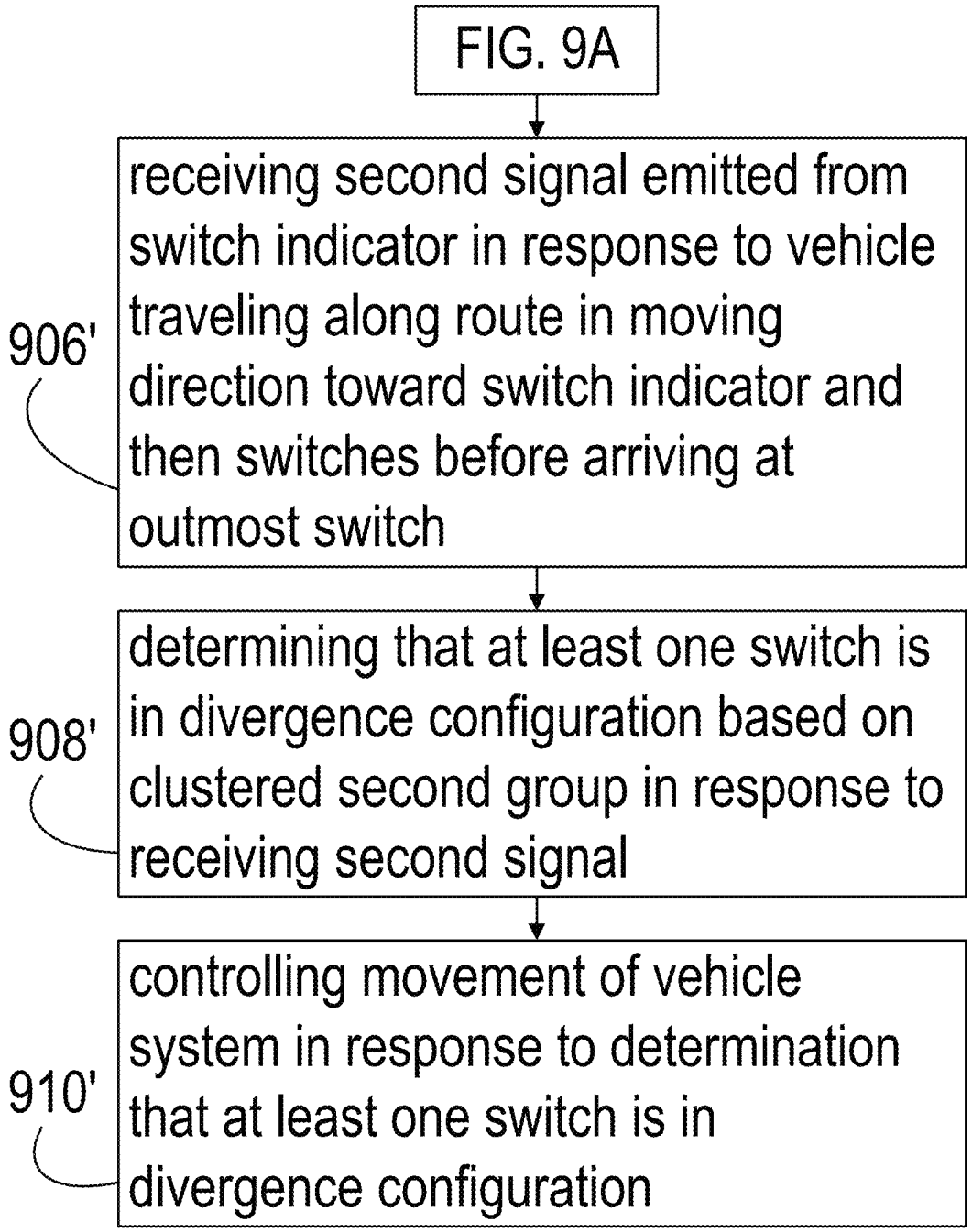
FIG. 9C illustrates a logic diagram of a method according to one embodiment.

In one embodiment, as shown in FIG. 9C, the control circuit determines 908' that at least one switch among the switches is in its divergence configuration based on the clustered second group in response to receiving the second signal. When the control circuit receives and identifies the second signal emitted from the first switch indicator, the control circuit determines that the at least one switch, or all the switches, is in its divergence configuration, as according to the clustered second group, when the first switch indicator emits the second signal, the one or more switches is in its divergence configuration.

In one embodiment, the control circuit controls 910, 910' movement of the vehicle system in response to a determination that each of the switches is in its alignment configuration (FIG. 9B) or that the at least one switch is in its divergence configuration (FIG. 9C).

In one embodiment, based on the determination that each of the switches is in its alignment configuration, whether "normal" or "reverse," according to the clustered first group, the control circuit determines that the first signal indicates a "clear" situation which means that the vehicle system is allowed to continue traveling along the route through all the switches, without being diverted into any other diverging route, in the first moving direction, as each of the switches is determined in its alignment configuration. The control circuit may increase, maintain, or decrease the speed of the vehicle system, or otherwise idle the vehicle system. Under the "clear" situation, the control circuit may choose to increase or maintain the speed of the vehicle system, if the vehicle system is scheduled in advance to travel along route without being diverted into any other diverging route, so as to decrease the traveling duration for the vehicle system or render the traveling duration unchanged.

In one embodiment, based on the determination that the at least one switch is in its divergence configuration, whether "normal" or "reverse," according to the clustered second group, the control circuit determines that the second signal indicates a "not clear" situation which means that the vehicle system is diverted into a diverging route at the at least one switch if the vehicle system may continue traveling along the route in the first moving direction. Under the "not clear" situation, the control circuit may choose to decrease the speed of the vehicle system, or even idle the vehicle system, before the vehicle system approaching each switch, such that the control circuit, or the operator (for instance, a human being or a robot or a machine) of the control circuit, may have extra time to independently observe and/or determine which configuration each switch is in, and then may further render the switch to its alignment configuration from its divergence configuration when necessary, if the vehicle system is scheduled in advance to travel along route without being diverted into any other diverging route, in the first moving direction.

In one embodiment, the control circuit determines whether an upcoming switch among the switches is in its alignment configuration or its divergence configuration in response to a determination that the at least one switch among the switches is in its divergence configuration. The at least one switch is located subsequent to the upcoming switch in the first moving direction for instance. For example, as shown in FIG. 1, when the control circuit determines that the most right switch is in its divergence configuration, the control circuit determines whether the most left switch, upon being approached by the vehicle system, is in its alignment configuration or its divergence configuration; alternatively, when the control circuit determines that the most right switch is in its divergence configuration, the control circuit determines whether the middle switch, upon being approached by the vehicle system, is in its alignment configuration or its divergence configuration; alternatively, when the control circuit determines that the middle switch is in its divergence configuration, the control circuit determines whether the most left switch, upon being approached by the vehicle system, is in its alignment configuration or its divergence configuration. Furthermore, the control circuit determines that a subsequent switch among the switches immediately after the upcoming switch in the first moving direction is in its divergence configuration in response to a determination that the upcoming switch is in its alignment configuration, as according to the clustered second group, when the first switch indicator emits the second signal, the one or more switches is in its divergence configuration. For example, as shown in FIG. 1, when the upcoming most left switch is determined as being in its alignment configuration, the control circuit determines that the middle switch immediately after the upcoming switch, i.e., the most left switch, is in its divergence configuration, based on the determination that the most left switch is in its alignment configuration while the second signal is received to indicate that at least one switch is in its divergence configuration.

In one embodiment, the control circuit determines whether an upcoming switch among the switches is in its alignment configuration or its divergence configuration in response to a determination that the at least one switch among the switches is in its divergence configuration, and determines that a subsequent switch among the switches after the upcoming switch in the first moving direction is in its divergence configuration in response to a determination that the upcoming switch is in its alignment configuration. For example, as shown in FIG. 1, when the control circuit determines that the most right switch located after the most left switch in the first moving direction of the vehicle system is in its divergence configuration, based on the determination that the most left switch is in its alignment configuration, while the second signal is received to indicate that at least one switch is in its divergence configuration.

In one embodiment, the control circuit embeds the clustered first group and the clustered second group into data, and to store the data in a route database, the control circuit retrieves the data from the route database in response to receiving the first signal or the second signal, the control circuit determines that each of the switches is in its alignment configuration based on the clustered first group embedded in the retrieved data in response to receiving the first signal, and the control circuit determines that the at least one switch among the switches is in its divergence configuration based on the clustered second group embedded in the retrieved data in response to receiving the second signal. The route database is stored in a storage device or medium on the system, the vehicle, the control center, or the control circuit readable storage device (in a later recitation), or an internet cloud, etc.

In one embodiment, the control circuit determines that each of the switches is in its divergence configuration in response to a determination that the at least one switch among the switches is in its divergence configuration based on the clustered second group.

Figure 4:
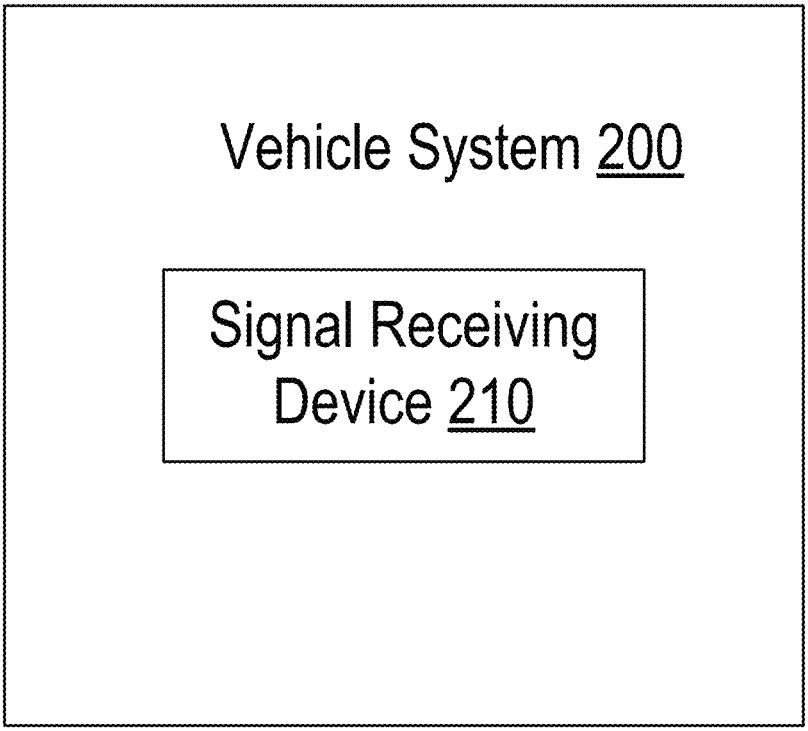
FIG. 4 illustrates a schematic diagram of a signal receiving device in a vehicle system according to one embodiment.
Figure 5:
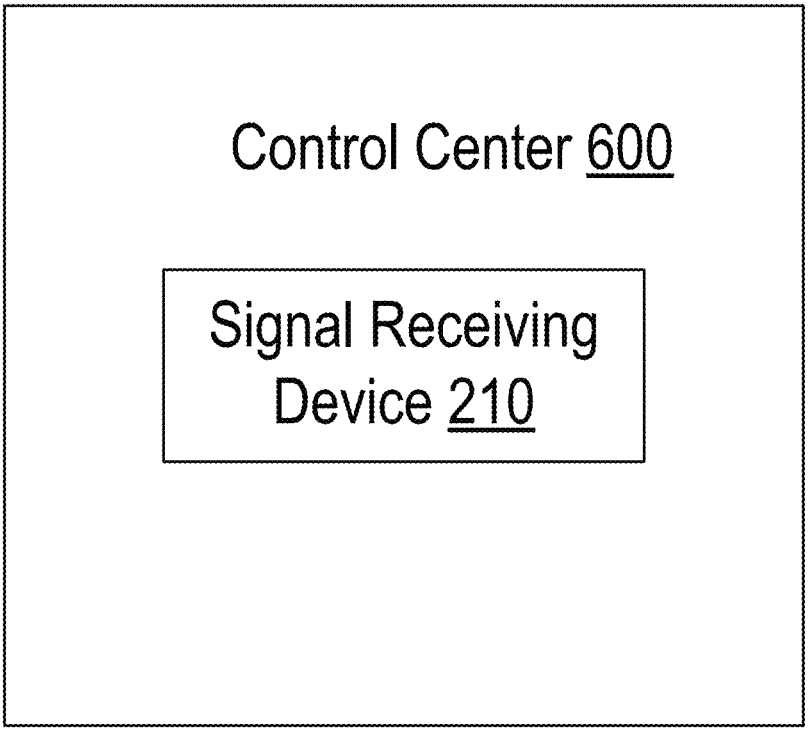
FIG. 5 illustrates a schematic diagram of a signal receiving device at a control center according to one embodiment.

In one embodiment, the control circuit receives and identifies the first signal or the second signal emitted from the first switch indicator by a signal receiving device 210 mounted on the vehicle system, as shown in FIG. 4, or located at a control center, as shown in FIG. 5, separate from the vehicle system.

In one embodiment, the control circuit selectively operates a switch among the switches to its alignment configuration for guiding the vehicle system to continue traveling along the route and to its divergence configuration for guiding the vehicle system to travel from the route to another route diverging from the route, such as a diverging route.

Figure 10A:
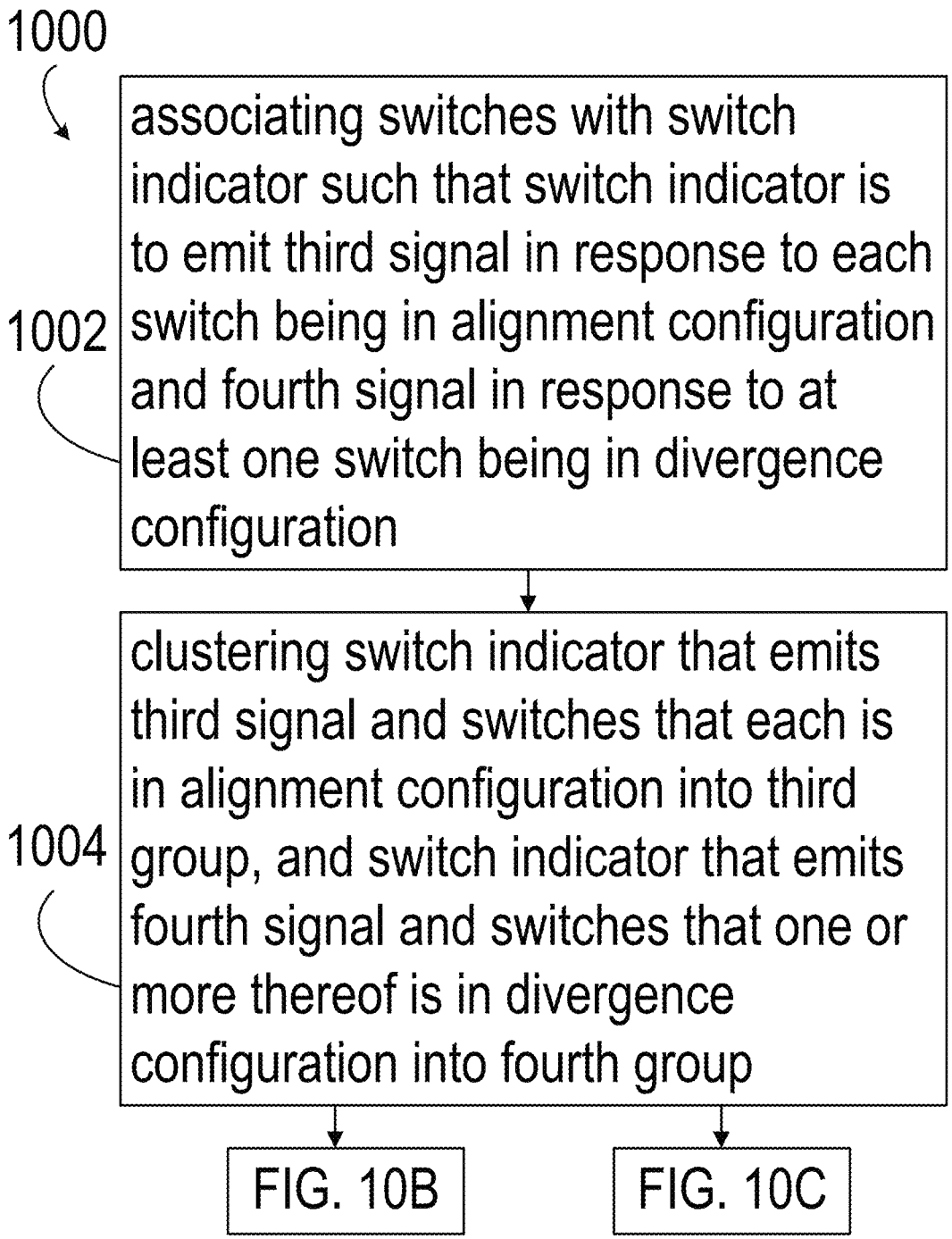
FIG. 10A illustrates a logic diagram of a method according to one embodiment.
Figure 10B:
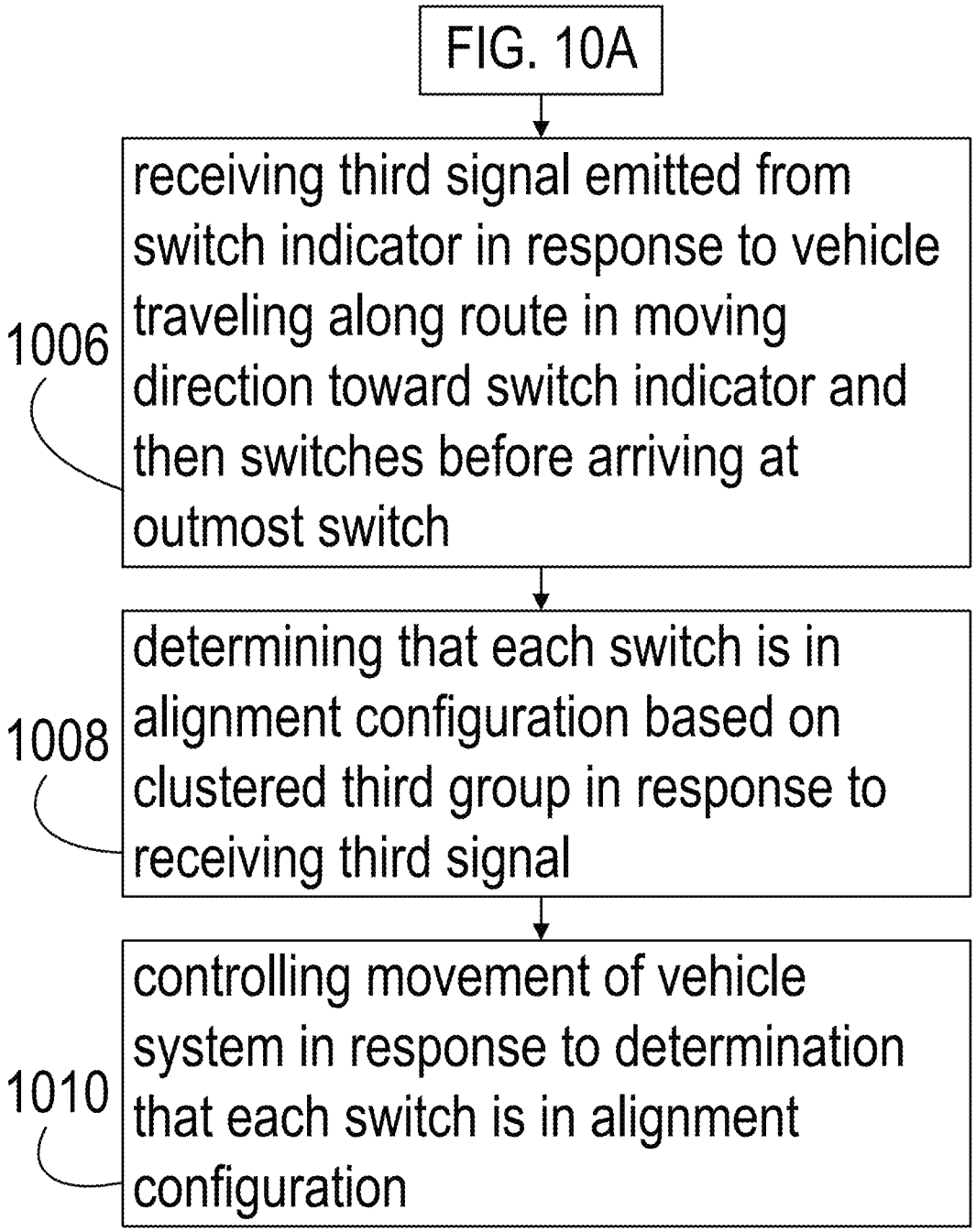
FIG. 10B illustrates a logic diagram of a method according to one embodiment.
Figure 10C:
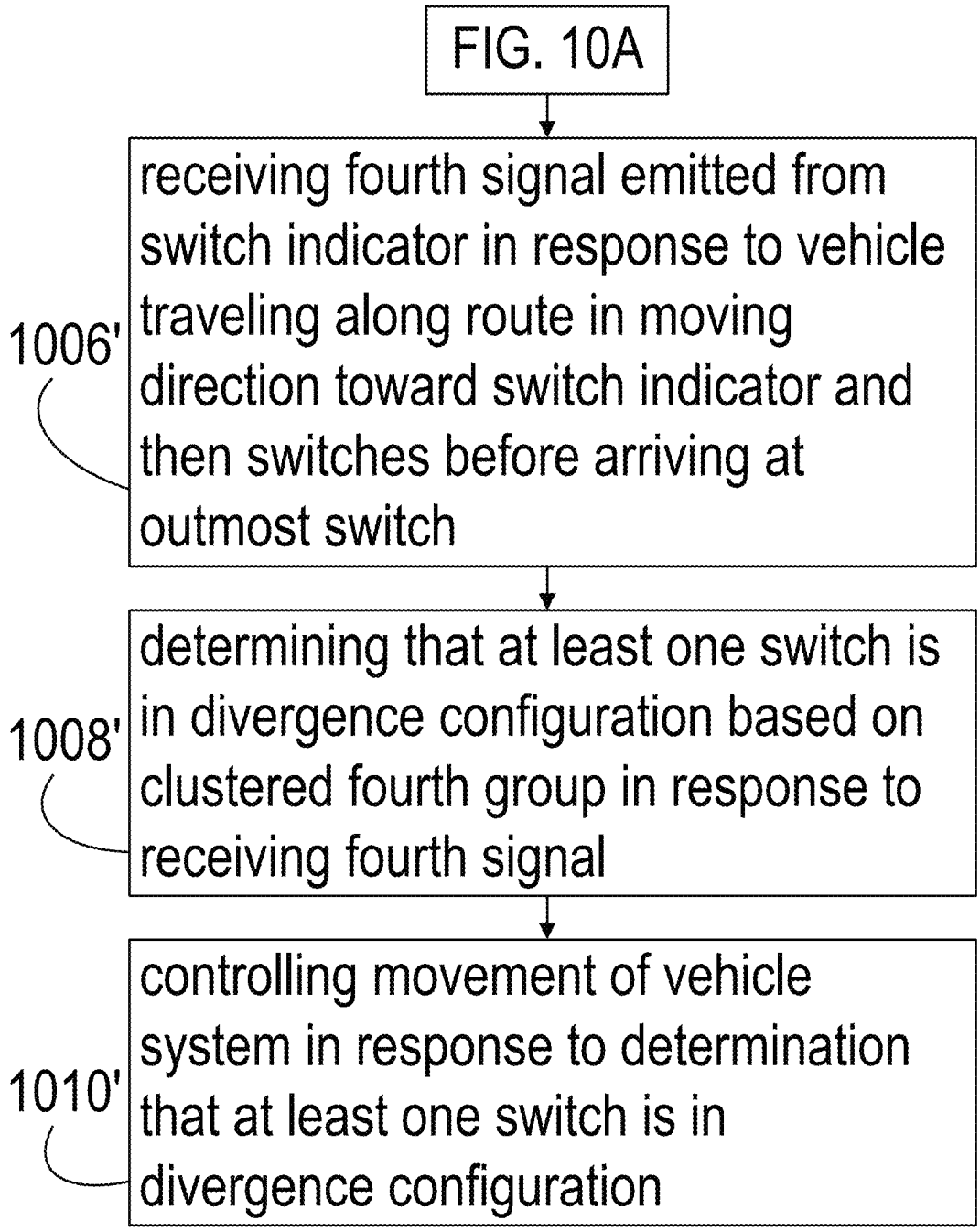
FIG. 10C illustrates a logic diagram of a method according to one embodiment.

In one embodiment, as shown in FIGS. 2, and 10A-10C, the control circuit associates 1002 a second switch indicator 700 deployed along the route with the switches sandwiched in between the first switch indicator and the second switch indicator such that the second switch indicator is to emit a third signal in response to each of the switches being in its alignment configuration and a fourth signal in response to the at least one switch being in its divergence configuration. As shown in FIG. 10A, the control circuit clusters 1004 the second switch indicator that emits the third signal and the switches that each is in its alignment configuration into a third group, and clusters the second switch indicator that emits the fourth signal and the switches that one or more thereof is in its divergence configuration into a fourth group. The control circuit receives and identifies 1006 the third signal, as shown in FIG. 10B, or receives 1006', as shown in FIG. 10C, the fourth signal emitted from the second switch indicator in response to the vehicle system traveling along the route in a second moving direction opposite to the first moving direction in FIG. 1 toward the second switch indicator and then the switches before arriving at a second outmost switch, such as the most right switch, among the switches opposite to the first outmost switch. The control circuit determines 1008, as shown in FIG. 10B, that each of the switches is in its alignment configuration based on the clustered third group in response to receiving the third signal. The control circuit determines 1008', as shown in FIG. 10C, that at least one switch among the switches is in its divergence configuration based on the clustered fourth group in response to receiving the fourth signal.

In one embodiment, the control circuit controls 1010, 1010' movement of the vehicle system in response to a determination that each of the switches is in its alignment configuration (FIG. 10B) or that the at least one switch is in its divergence configuration (FIG. 10C).

In one embodiment, based on the determination that each of the switches is in its alignment configuration, whether "normal" or "reverse," according to the clustered third group, the control circuit determines that the third signal indicates a "clear" situation which means that the vehicle system is allowed to continue traveling along the route through all the switches, without being diverted into any other diverging route, in the second moving direction, as each of the switches is determined in its alignment configuration. The control circuit may increase, maintain, or decrease the speed of the vehicle system, or otherwise idle the vehicle system. Under the "clear" situation, the control circuit may choose to increase or maintain the speed of the vehicle system, if the vehicle system is scheduled in advance to travel along route without being diverted into any other diverging route, so as to decrease the traveling duration for the vehicle system or render the traveling duration unchanged.

In one embodiment, based on the determination that the at least one switch is in its divergence configuration, whether "normal" or "reverse," according to the clustered fourth group, the control circuit determines that the fourth signal indicates a "not clear" situation which means that the vehicle system is diverted into a diverging route at the at least one switch if the vehicle system may continue traveling along the route in the second moving direction. Under the "not clear" situation, the control circuit may choose to decrease the speed of the vehicle system, or even idle the vehicle system, before the vehicle system approaching each switch, such that the control circuit, or the operator (for instance, a human being or a robot or a machine) of the control circuit, may have extra time to independently observe and/or determine which configuration each switch is in, and then may further render the switch to its alignment configuration from its divergence configuration when necessary, if the vehicle system is scheduled in advance to travel along route without being diverted into any other diverging route, in the second moving direction.

In one embodiment, the control circuit determines whether an upcoming switch among the switches is in its alignment configuration or its divergence configuration in response to a determination that the at least one switch among the switches is in its divergence configuration, and the control circuit determines that a subsequent switch among the switches immediately after the upcoming switch in the second moving direction is in its divergence configuration in response to a determination that the upcoming switch is in its alignment configuration.

In one embodiment, the control circuit determines whether an upcoming switch among the switches is in its alignment configuration or its divergence configuration in response to a determination that the at least one switch among the switches is in its divergence configuration, and the control circuit determines that a subsequent switch among the switches after the upcoming switch in the second moving direction is in its divergence configuration in response to a determination that the upcoming switch is in its alignment configuration.

In one embodiment, the control circuit embeds the clustered third group and the clustered fourth group into data in a route database, the control circuit retrieves the data from the route database in response to receiving the third signal or the fourth signal, the control circuit determines that each of the switches is in its alignment configuration based on the clustered third group embedded in the retrieved data in response to receiving the third signal, and the control circuit determines that the at least one switch among the switches is in its divergence configuration based on the clustered fourth group embedded in the retrieved data in response to receiving the fourth indication signal.

In one embodiment, the control circuit determines that each of the switches is in its divergence configuration in response to a determination that the at least one switch among the switches is in its divergence configuration.

In one embodiment, the control circuit receives and identifies the third signal or the fourth signal emitted from the second switch indicator by a signal receiving device mounted on the vehicle system or located at a control center separate from the vehicle system.

In one embodiment, the control circuit associates the first switch indicator and the second switch indicator with each other such that the second switch indicator is to emit the third signal in response to the first switch indicator emitting the first signal and the second switch indicator is to emit the fourth signal in response to the first switch indicator emitting the second signal. In one embodiment, the first signal and the third signal are emitted synchronously or asynchronously, and the second signal and the fourth signal are emitted synchronously or asynchronously.

In one embodiment, the first switch indicator and the second switch indicator are similar to or the same as each other, the first signal and the third signal are similar to or the same as each other while the second signal and the fourth signal is similar to or the same as each other, and the first group and the third group is integrated into the same group while the second group and the fourth group is integrated into the same group.

Referring to FIGS. 9A-9C, in one embodiment, the method is executed in full or in part by the control circuit as above recited. The method is used for inferring status of the switches positioned along the route traveled by the vehicle system.

In one embodiment, the method comprises associating a switches deployed sequentially along a route with a first switch indicator deployed along the route and located subsequent to or prior to the switches such that the first switch indicator is to emit a first signal in response to each of the switches being in its alignment configuration of aligning with the route and a second signal in response to at least one of the switches being in its divergence configuration of diverging from the route.

In one embodiment, the method comprises clustering the first switch indicator that emits the first signal and the switches that each is in its alignment configuration into a first group. In one embodiment, the method comprises clustering the first switch indicator that emits the second signal and the switches that one or more thereof is in its divergence configuration into a second group.

In one embodiment, the method comprises receiving the first signal or the second signal emitted from the first switch indicator in response to the vehicle system traveling along the route in a first moving direction toward the first switch indicator and then the switches before arriving at a first outmost switch among the switches.

In one embodiment, the method comprises determining that each of the switches is in its alignment configuration based on the clustered first group in response to receiving the first signal. In one embodiment, the method comprises determining that at least one switch among the switches is in its divergence configuration based on the clustered second group in response to receiving the second signal.

In one embodiment, the method comprises controlling movement of the vehicle method in response to a determination that each of the switches is in its alignment configuration or that the at least one switch is in its divergence configuration.

In one embodiment, the method comprises determining whether an upcoming switch among the switches is in its alignment configuration or its divergence configuration in response to a determination that the at least one switch among the switches is in its divergence configuration. In one embodiment, the method comprises determining that a subsequent switch among the switches immediately after the upcoming switch in the first moving direction is in its divergence configuration in response to a determination that the upcoming switch is in its alignment configuration.

In one embodiment, the method comprises determining whether an upcoming switch among the switches is in its alignment configuration or its divergence configuration in response to a determination that the at least one switch among the switches is in its divergence configuration. In one embodiment, the method comprises determining that a subsequent switch among the switches after the upcoming switch in the first moving direction is in its divergence configuration in response to a determination that the upcoming switch is in its alignment configuration.

In one embodiment, the method comprises embedding the clustered first group and the clustered second group into data in a route database. In one embodiment, the method comprises retrieving the data from the route database in response to receiving the first signal or the second signal. In one embodiment, the method comprises determining that each of the switches is in its alignment configuration based on the clustered first group embedded in the retrieved data in response to receiving the first signal. In one embodiment, the method comprises determining that the at least one switch among the switches is in its divergence configuration based on the clustered second group embedded in the retrieved data in response to receiving the second signal.

In one embodiment, the method comprises determining that each of the switches is in its divergence configuration in response to a determination that the at least one switch among the switches is in its divergence configuration.

In one embodiment, the method comprises receiving the first signal or the second signal emitted from the first switch indicator by a signal receiving device mounted on the vehicle method or located at a control center separate from the vehicle method.

In one embodiment, the method comprises selectively operating a switch among the switches to its alignment configuration for guiding the vehicle method to continue traveling along the route and to its divergence configuration for guiding the vehicle method to travel from the route to another route diverging from the route.

In one embodiment, the method comprises associating a second switch indicator deployed along the route with the switches sandwiched in between the first switch indicator and the second switch indicator such that the second switch indicator is to emit a third signal in response to each of the switches being in its alignment configuration and a fourth signal in response to the at least one switch being in its divergence configuration.

In one embodiment, the method comprises clustering the second switch indicator that emits the third signal and the switches that each is in its alignment configuration into a third group. In one embodiment, the method comprises clustering the second switch indicator that emits the fourth signal and the switches that one or more thereof is in its divergence configuration into a fourth group.

In one embodiment, the method comprises receiving the third signal or the fourth signal emitted from the second switch indicator in response to the vehicle system traveling along the route in a second moving direction opposite to the first moving direction toward the second switch indicator and then the switches before arriving at a second outmost switch among the switches opposite to the first outmost switch.

In one embodiment, the method comprises determining that each of the switches is in its alignment configuration based on the clustered third group in response to receiving the third signal. In one embodiment, the method comprises determining that at least one switch among the switches is in its divergence configuration based on the clustered fourth group in response to receiving the fourth signal.

In one embodiment, the method comprises determining whether an upcoming switch among the switches is in its alignment configuration or its divergence configuration in response to a determination that the at least one switch among the switches is in its divergence configuration. In one embodiment, the method comprises determining that a subsequent switch among the switches immediately after the upcoming switch in the second moving direction is in its divergence configuration in response to a determination that the upcoming switch is in its alignment configuration.

In one embodiment, the method comprises determining whether an upcoming switch among the switches is in its alignment configuration or its divergence configuration in response to a determination that the at least one switch among the switches is in its divergence configuration. In one embodiment, the method comprises determining that a subsequent switch among the switches after the upcoming switch in the second moving direction is in its divergence configuration in response to a determination that the upcoming switch is in its alignment configuration.

In one embodiment, the method comprises embedding the clustered third group and the clustered fourth group into data in a route database. In one embodiment, the method comprises retrieving the data from the route database in response to receiving the third signal or the fourth signal. In one embodiment, the method comprises determining that each of the switches is in its alignment configuration based on the clustered third group embedded in the retrieved data in response to receiving the third signal. In one embodiment, the method comprises determining that the at least one switch among the switches is in its divergence configuration based on the clustered fourth group embedded in the retrieved data in response to receiving the fourth indication signal.

In one embodiment, the method comprises determining that each of the switches is in its divergence configuration in response to a determination that the at least one switch among the switches is in its divergence configuration.

In one embodiment, the method comprises receiving the third signal or the fourth signal emitted from the second switch indicator by a signal receiving device mounted on the vehicle method or located at a control center separate from the vehicle method.

In one embodiment, the method comprises associating the first switch indicator and the second switch indicator with each other such that the second switch indicator is to emit the third signal in response to the first switch indicator emitting the first signal and the second switch indicator is to emit the fourth signal in response to the first switch indicator emitting the second signal.

In one embodiment, the first signal and the third signal is emitted synchronously or asynchronously, and the second signal and the fourth signal is emitted synchronously or asynchronously.

Figure 8:
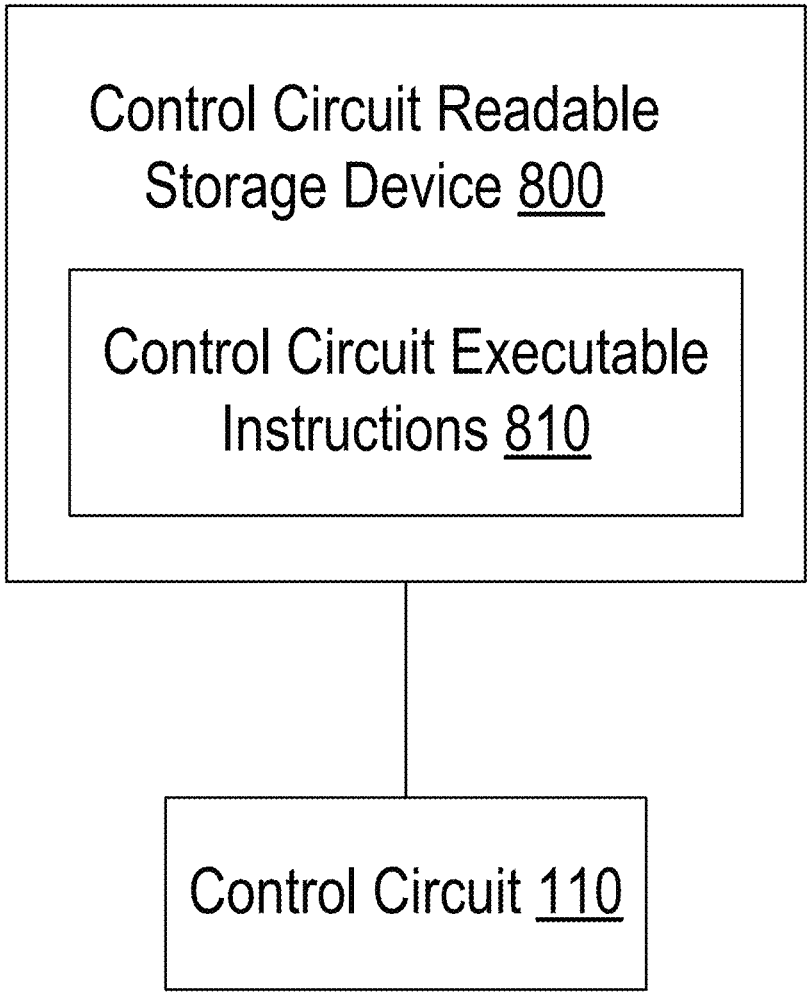
FIG. 8 illustrates a schematic diagram of a control circuit readable storage device coupled with a control circuit according to one embodiment.

In one embodiment, the control circuit readable storage device 800 has control circuit executable instructions 810 stored therein causing a control circuit as above recited to perform the above recited method. In one embodiment, the control circuit readable storage device is coupled with the control circuit, as shown in FIG. 8.

In one embodiment, a system includes a control circuit. The control circuit associates a plurality of switches deployed sequentially along a route with a first switch indicator deployed along the route and located subsequent to or prior to the plurality of switches such that the first switch indicator is to emit a first signal in response to each of the plurality of switches being in its alignment configuration of aligning with the route. The control circuit further clusters the first switch indicator that emits the first signal and the plurality of switches that each is in its alignment configuration into a first group. The control circuit further determines that each of the plurality of switches is in its alignment configuration based on the clustered first group in response to receiving the first signal emitted from the first switch indicator in response to the vehicle system traveling along the route in a moving direction toward the first switch indicator and then the plurality of switches before arriving at a first outmost switch among the plurality of switches. The control circuit further controls movement of the vehicle system in response to a determination that the plurality of switches each is in its alignment configuration.

In one embodiment, the control circuit further embeds the clustered first group into data in a route database, further retrieves the data from the route database in response to receiving the first signal, and further determines that each of the plurality of switches is in its alignment configuration based on the clustered first group embedded in the retrieved data in response to receiving the first signal.

In one embodiment, the control circuit further receive the first signal emitted from the first switch indicator by a signal receiving device mounted on the vehicle system or located at a control center separate from the vehicle system.

In one embodiment, the control circuit further selectively operates a switch among the plurality of switches to its alignment configuration for guiding the vehicle system to continue traveling along the route and to its divergence configuration of diverging from the route for guiding the vehicle system to travel from the route to another route diverging from the route.

In one embodiment, the control circuit further associates the plurality of switches with the first switch indicator such that the first switch indicator is to further emit a second signal in response to that at least one of the plurality of switches being in its non-correspondence configuration. The control circuit further clusters the first switch indicator that emits the second signal and the plurality of switches that one or more thereof is in its non-correspondence configuration into a second group. The control circuit further determines that at least one switch among the plurality of switches is in its non-correspondence configuration based on the clustered second group in response to receiving the second signal emitted from the first switch indicator in response to the vehicle system traveling along the route in the moving direction toward the first switch indicator and then the plurality of switches before arriving at the first outmost switch among the plurality of switches. The control circuit further controls movement of the vehicle system in response to a determination that the at least one switch is in its non-correspondence configuration.

In one embodiment, the control circuit further determines whether an upcoming switch among the plurality of switches is in its alignment configuration or its divergence configuration of diverging from the route in response to a determination that the at least one switch among the plurality of switches is in its non-correspondence configuration, and further determines that a subsequent switch among the plurality of switches immediately after the upcoming switch in the moving direction is in its non-correspondence configuration in response to a determination that the upcoming switch is in its alignment configuration or its divergence configuration.

In one embodiment, the control circuit further determines whether an upcoming switch among the plurality of switches is in its alignment configuration or its divergence configuration of diverging from the route in response to a determination that the at least one switch among the plurality of switches is in its non-correspondence configuration, and further determines that a subsequent switch among the plurality of switches after the upcoming switch in the moving direction is in its non-correspondence configuration in response to a determination that the upcoming switch is in its alignment configuration or its divergence configuration.

In one embodiment, the control circuit further embeds clustered second group into data in a route database, further retrieves the data from the route database in response to receiving the second signal, and further determines that the at least one switch among the plurality of switches is in its non-correspondence configuration based on the clustered second group embedded in the retrieved data in response to receiving the second signal.

In one embodiment, the control circuit further determines that each of the plurality of switches is in its alignment configuration, divergence configuration, or non-correspondence configuration in response to a determination that the at least one switch among the plurality of switches is in its non-correspondence configuration.

In one embodiment, the control circuit further receives the second signal emitted from the first switch indicator by a signal receiving device mounted on the vehicle system or located at a control center separate from the vehicle system.

In one embodiment, that the at least one of the plurality of switches is in its non-correspondence configuration indicates that the at least one of the plurality of switches is in its divergence configuration of diverging from the route, or that the at least one of the plurality of switches is in a configuration of which a status is unknown.

In one embodiment, based on the determination that the at least one switch is in its divergence configuration, whether "normal" or "reverse," according to the clustered second group, the control circuit determines that the second signal indicates a "not clear" situation which means that the vehicle system is diverted into a diverging route at the at least one switch if the vehicle system may continue traveling along the route in the moving direction. Under the "not clear" situation, the control circuit may choose to decrease the speed of the vehicle system, or even idle the vehicle system, before the vehicle system approaching each switch, such that the control circuit, or the operator (for instance, a human being or a robot or a machine) of the control circuit, may have extra time to independently observe and/or determine which configuration each switch is in, and then may further render the switch to its alignment configuration from its divergence configuration when necessary, if the vehicle system is scheduled in advance to travel along route without being diverted into any other diverging route, in the moving direction.

In one embodiment, based on the determination that the at least one switch is in a configuration of which a status is unknown, regardless that it is actually "normal" or "reverse," according to the clustered second group, the control circuit determines that the second signal indicates an "unknown" situation which means that the vehicle system may be diverted into a diverging route at the at least one switch if the vehicle system may continue traveling along the route in the moving direction, or that the vehicle system may be allowed to continue traveling along the route through all the switches, or at least at the at least one switch, without being diverted into any other diverging route, in the moving direction. Under the "unknown" situation, the control circuit may choose to decrease the speed of the vehicle system, or even idle the vehicle system, before the vehicle system approaching each switch, such that the control circuit, or the operator (for instance, a human being or a robot or a machine) of the control circuit, may have extra time to independently observe and/or determine which configuration, i.e., alignment configuration or divergence configuration, each switch is actually in, and then may further render the switch to its alignment configuration from its divergence configuration when necessary, if the vehicle system is scheduled in advance to travel along route without being diverted into any other diverging route, in the moving direction, or vice versa.

In one embodiment, the control circuit further associates the plurality of switches with a second switch indicator, as previously recited, such that the second switch indicator is to emit a third signal similar to or the same as the first signal and a fourth signal similar to or the same as the second signal in response to the vehicle system traveling along the route in another moving direction opposite to the moving direction. In one embodiment, the control circuit associates the plurality of switches with the second switch indicator such that the second switch indicator is to emit the third signal in response to each of the plurality of switches being in its alignment configuration. In one embodiment, the control circuit associates the plurality of switches with the second switch indicator such that the second switch indicator is to emit the fourth signal in response to that at least one of the plurality of switches being in its non-correspondence configuration.

In one embodiment, a method is executed in full or in part by the control circuit as above recited.

Movement of the vehicle may include propelling the vehicle forward or backward along a direction of travel, as well as slowing or stopping the vehicle. Movement further may include turning left or right, and increasing or decreasing elevation or depth. Movement further may include determining or setting a vehicle speed, changing a vehicle speed, matching speeds between vehicles. Indirectly, movement of the vehicle may include ramping up (or down) power sources; and this may include energizing electrical circuits or buses, setting fuel flow rates, setting engine RPM rates, and the like. Each route having a top portion. In various embodiments, the top portion of the route may be a running surface, or a resting surface, for a vehicle. Groups of two or more vehicles traveling together in a coordinated manner may be referred to as a consist, swarm, fleet, convoy, fleet and the like. Embodiments may be described in connection with a rail vehicle system, or other types of vehicle systems, such as automobiles, trucks (with or without trailers), buses, marine vessels, aircraft, unmanned aircraft (e.g., drones), mining vehicles, agricultural vehicles, or other off-highway vehicles. The vehicle systems described herein (rail vehicle systems or other vehicle systems that do not travel on rails or tracks) may be formed from a single vehicle or multiple vehicles. With respect to multi-vehicle systems, the vehicles may be mechanically coupled with each other (e.g., by couplers) or logically coupled but not mechanically coupled. For example, vehicles may be logically but not mechanically coupled when the separate vehicles communicate with each other to coordinate movements of the vehicles with each other so that the vehicles travel together (e.g., as a convoy). Calculations and computations may be performed on-board the vehicle systems or off-board the vehicle systems and then communicated to the vehicle systems. An on-board or off-board vehicle control system may receive sensor inputs, operator inputs, vehicle parameters, and route parameters, etc.

The calculations and computations may be implemented in an artificial intelligence (AI) or machine-learning system. In one embodiment, a control system, a control circuit, or a controller, may have a local data collection system deployed and may use machine learning to enable derivation-based learning outcomes. The controller may learn from and make decisions on a set of data (including data provided by the various sensors), by making data-driven predictions and adapting according to the set of data. In embodiments, machine learning may involve performing a plurality of machine learning tasks by machine learning systems, such as supervised learning, unsupervised learning, and reinforcement learning. Supervised learning may include presenting a set of example inputs and desired outputs to the machine learning systems. Unsupervised learning may include the learning algorithm structuring its input by methods such as pattern detection and/or feature learning. Reinforcement learning may include the machine learning systems performing in a dynamic environment and then providing feedback about correct and incorrect decisions. Machine learning may include a plurality of other tasks based on an output of the machine learning system. The tasks may be machine learning problems such as classification, regression, clustering, density estimation, dimensionality reduction, anomaly detection, and the like. Machine learning may include a plurality of mathematical and statistical techniques. The machine learning algorithms may include decision tree based learning, association rule learning, deep learning, artificial neural networks, genetic learning algorithms, inductive logic programming, support vector machines (SVMs), Bayesian network, reinforcement learning, representation learning, rule-based machine learning, sparse dictionary learning, similarity and metric learning, learning classifier systems (LCS), logistic regression, random forest, K-Means, gradient boost, K-nearest neighbors (KNN), a priori algorithms, and the like. In embodiments, certain machine learning algorithms may be used (e.g., for solving both constrained and unconstrained optimization problems that may be based on natural selection). The algorithm may be used to address problems of mixed integer programming, where some components are restricted to being integer-valued. Algorithms and machine learning techniques and systems may be used in computational intelligence systems, computer vision, Natural Language Processing (NLP), recommender systems, reinforcement learning, building graphical models, and the like. Machine learning may be used for vehicle performance and control, behavior analytics, and the like.

In one embodiment, the controller may include a policy engine that may apply one or more policies. These policies may be based at least in part on characteristics of a given item of equipment or environment. With respect to control policies, a neural network can receive input of a number of environmental and task-related parameters. The neural network can be trained to generate an output based on these inputs, with the output representing an action or sequence of actions that the engine system should take. This may be useful for balancing competing constraints on the engine. During operation of one embodiment, a determination can occur by processing the inputs through the parameters of the neural network to generate a value at the output node designating that action as the desired action. This action may translate into a signal that causes the engine to operate. This may be accomplished via backpropagation, feed forward processes, closed loop feedback, or open loop feedback. Alternatively, rather than using backpropagation, the machine learning system of the controller may use evolution strategies techniques to tune various parameters of the artificial neural network. The controller may use neural network architectures with functions that may not always be solvable using backpropagation, for example functions that are non-convex. In one embodiment, the neural network has a set of parameters representing weights of its node connections. A number of copies of this network may be generated and then different adjustments to the parameters may be made, and simulations may be done. Once the output from the various models may be obtained, they may be evaluated on their performance using a determined success metric. The best model may be selected, and the vehicle controller may execute that plan to achieve the desired input data to mirror the predicted best outcome scenario. Additionally, the success metric may be a combination of the optimized outcomes. These may be weighed relative to each other.

The methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but may be provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions may be carried out by executing the instructions in a system including the various engine hardware components in combination with the electronic controller.

As used herein, an element or step recited in the singular and proceeded with the word "a" or "an" may not exclude the plural of said elements or operations, unless such exclusion may be explicitly stated. Furthermore, references to "one embodiment" of the invention may not exclude the existence of additional embodiments that may incorporate the recited features. Moreover, unless explicitly stated to the contrary, embodiments "comprising," "comprises," "including," "includes," "having," or "has" an element or a plurality of elements having a particular property may include additional such elements not having that property. Terms "including" and "in which" may be used as the plain-English equivalents of the respective terms "comprising" and "wherein." Moreover, terms "first," "second," and "third," etc. may be used merely as labels, and may not impose numerical requirements on their objects. Further, the limitations of the following claims may not be written in means-plus-function format and may not be intended to be interpreted based on 35 U.S.C. § 112(f), unless and until such claim limitations may expressly use the phrase "means for" followed by a statement of function devoid of further structure.

The above description may be illustrative, and not restrictive. Embodiments may not be mutually exclusive to each other. The above-described embodiments (and/or aspects thereof) may be used in combination with each other. In addition, many modifications may be made to adapt a particular situation or material to the teachings of the subject matter without departing from its scope. While the dimensions and types of materials described herein may define the parameters of the subject matter, they may be exemplary embodiments. Other embodiments may be apparent to one of ordinary skill in the art upon reviewing the above description. The scope of the subject matter may, therefore, be determined with reference to the appended claims, along with the full scope of equivalents to which such claims may be entitled.

This written description may disclose several embodiments of the subject matter, including the best mode, and may enable one of ordinary skill in the art to practice the embodiments of subject matter, including making and using any devices or systems and performing any incorporated methods. The patentable scope of the subject matter may be defined by the claims, and may include other embodiments that may occur to one of ordinary skill in the art. Such other embodiments may be intended to be within the scope of the claims if they may have structural elements that may not differ from the literal language of the claims, or if they may include equivalent structural elements with insubstantial differences from the literal languages of the claims.

A reference herein to a patent document or any other matter identified as prior art, is not to be taken as an admission that the document or other matter may be known or that the information it may contain may be part of the common general knowledge as at the priority date of any of the claims.

The foregoing description presents various embodiments of systems and processes through block diagrams, flowcharts, and examples. Each of the depicted components, functions, or operations may be implemented using hardware, software, firmware, or combinations thereof. Specific features can be executed using integrated circuits, computer programs, or processors (e.g., microprocessors, microcontrollers), as well as other software-hardware combinations. The design and development of such implementations, whether via circuitry or software, are within the technical expertise of those skilled in the art. Moreover, the described methods and mechanisms may be distributed as program products on various media, with no restriction on the format of the medium.

Instructions for implementing these features can be stored in various types of memory, including dynamic random-access memory (DRAM), flash memory, and/or cache. These instructions can also be distributed over a network or via other computer-readable media. The term "non-transitory computer-readable medium" refers to any physical medium capable of storing or transmitting instructions or information that can be read by a machine. Examples include, but are not limited to, optical disks, CD-ROMs, RAM, ROM, EPROM, EEPROM, magnetic or optical cards, flash memory, or even propagated signals such as carrier waves or infrared signals.

Software components described herein may be implemented using languages such as Python, Java, C++, or Perl. The corresponding software code may be stored on various computer-readable media, such as RAM, ROM, hard drives, or CD-ROMs. These media may be part of a single computational device or distributed across multiple devices within a networked system.

The term "control circuit" encompasses hardwired circuitry, programmable logic (such as microprocessors, microcontrollers, digital signal processors (DSPs), programmable logic devices (PLDs), programmable gate arrays (PGAs), or field-programmable gate arrays (FPGAs)), state machines, or firmware that executes stored instructions. Control circuits may form part of larger systems, such as integrated circuits (ICs), application-specific integrated circuits (ASICs), or systems-on-chips (SoCs), and are commonly found in devices such as computers, smartphones, and servers. These circuits may perform tasks involving data processing, communication, or data storage.

In some embodiments, the control circuit can utilize machine learning (ML) techniques to make decisions based on sensor inputs or other data. ML methods may include supervised learning (with labeled inputs and outputs), unsupervised learning (for identifying patterns), or reinforcement learning (where the system adapts based on feedback). Tasks for ML systems may involve classification, regression, clustering, anomaly detection, or optimization, with algorithms such as decision trees, deep learning, support vector machines (SVMs), or neural networks being employed, depending on the application.

A control circuit may also incorporate a policy engine that applies specific rules based on equipment characteristics or environmental conditions. For instance, a neural network could process sensor data or operational inputs to determine appropriate actions. Techniques such as backpropagation or evolutionary strategies may be used to refine neural network parameters and optimize model selection for the given task.

The system may handle data generation, transmission, and storage, potentially leveraging both protected and exposed data sources. Encryption and decryption can be applied during data transit, at rest, or in use, with keys and schemas determined based on operational needs. The control circuit may monitor and enforce decision boundaries, ensuring that data from protected sources meets safety or operational thresholds. If data breaches these boundaries, the system may initiate actions such as equipment shutdown, component isolation, or transitioning to safe mode to mitigate potential risks or damages.

In one embodiment, the control circuit, controller, and systems described herein may use machine learning to make determinations and to enable derivation-based learning outcomes. The system may communicate with a data collection system. The control circuit may learn from, model and make decisions/determinations on a set of data (including data provided by various sensors and data collection systems) by making data-driven predictions and adapting according to available data and modeling. Machine learning may involve performing tasks using supervised learning, unsupervised learning, and reinforcement learning systems. Supervised learning may use a set of example inputs and desired outputs to the machine learning systems, where unsupervised learning may use a learning algorithm that is structuring its input with, e.g., pattern detection and/or feature learning. Reinforcement learning may perform in a dynamic environment and then provide feedback about correct and incorrect decisions. Machine learning may include tasks based on certain outputs. These tasks may be machine learning problems such as classification, regression, clustering, density estimation, dimensionality reduction, anomaly detection, and the like to include other mathematical and statistical techniques. Suitable machine learning algorithmic types may include decision tree based learning, association rule learning, deep learning, artificial neural networks, genetic learning algorithms, inductive logic programming, support vector machines (SVMs), Bayesian network, reinforcement learning, representation learning, rule-based machine learning, sparse dictionary learning, similarity and metric learning, learning classifier systems (LCS), logistic regression, random forest, K-Means, gradient boost, K-nearest neighbors (KNN), a priori algorithms, and the like. In embodiments, certain machine learning algorithms may be used (e.g., for solving both constrained and unconstrained optimization problems that may be based on natural selection). In an example, the algorithm may be used to address problems of mixed integer programming, where some components restricted to being integer-valued. Algorithms and machine learning techniques and systems may be used in computational intelligence systems, computer vision, Natural Language Processing (NLP), recommender systems, reinforcement learning, building graphical models, and the like. In an example, machine learning may be used for making determinations, calculations, comparisons and behavior analytics, and the like.

In one embodiment, the control circuit may include a policy engine. The policies the engine may apply can be based at least in part on characteristics of a given item of equipment or environment. For example, an artificial intelligence system, such as a neural network, can receive input of a number of environmental and task-related parameters. These parameters may include, for example, operational input of the given equipment, data from various sensors, environmental information, location and/or position data, and the like. The neural network can be trained and can generate an output based on these inputs, with the output representing an action or sequence of actions that the equipment or system should take to accomplish the goal of the operation. The control circuit can process the inputs through the parameters of the neural network to generate a value (i.e., make a determination) at the output node designating that action as the desired action, activity, or operating state. An action may translate into a signal that causes the vehicle to operate in a particular manner. The control circuit may accomplish this via back-propagation, feed forward processes, closed loop feedback, or open loop feedback, for example. Alternatively, rather than using backpropagation, the control circuit may use evolution strategies techniques to tune various parameters of the neural network. The control circuit may use neural network architectures that have a set of parameters representing weights of its node connections. A number of copies of this network can be generated and adjustments to the parameters can be made with subsequent simulations. Once the outputs from the various models have been obtained, they may be evaluated on their performance using a determined success metric. The best model is selected, and the control circuit can execute that plan to achieve the desired input data to mirror the predicted best outcome scenario. Additionally, the success metric itself may be a combination of the optimized outcomes, which may be weighed relative to each other. Success metrics may be dynamically established, and the process rerun and the equipment directions further modified.

In one embodiment, data can be generated, transmitted, and stored and may involve one or both of a protected space data source and the exposed space data source. The control circuit may encrypt and decrypt data as needed at rest, during use, or in transit. Encryption keys and schema may be selected and implemented as informed by end use parameters and requirements. The control circuit may evaluate and/or identify a decision boundary (that is, a boundary that separates desired behavior from undesired behavior) with regard to that data. If the control circuit determines that some quantity of data is from a protected space data source and/or is operating within determined boundaries then the control circuit, and the equipment being controlled, may operate normally. However, if the data is determined to be from an exposed space data source and/or it crosses the decision boundary, the control circuit may respond. Suitable responses may be to power down determined equipment, signal an alert, run a diagnostic routine, perform a data backup (without overwriting existing backup data), isolate equipment (including by suspending some or all communication pathways), switch equipment or control operations to a safe mode of the control system, and/or initiate a safe mode state of the equipment (e.g., slow a vehicle to a safe and controlled stop). The safe mode may be, in one embodiment, a soft shutdown mode that it intended to avoid damage or injury based on the shutdown itself and in another embodiment may be a reboot and/or minimal reload of essential drivers and functionality.

The term "logic" refers to software, firmware, and/or circuitry configured to execute the described operations. Logic may be implemented as applications, software packages, instruction sets, or data stored on non-transitory computer-readable storage media. Firmware may be hard-coded into memory devices. Components and modules described herein may be hardware, software, or a combination thereof, and may be in active, inactive, or standby states depending on system requirements.

An "algorithm" refers to a sequence of steps designed to achieve a specific result. These steps may manipulate physical quantities, typically in the form of electrical or magnetic signals, which are represented as bits, values, symbols, or numbers. The terms used to describe these processes are labels for the underlying physical operations.

The system may operate over a packet-switched network using various communication protocols, including Ethernet (complying with IEEE 802.3 standards), X.25, frame relay, or Asynchronous Transfer Mode (ATM). Communication between devices may follow established protocols such as TCP/IP or new emerging standards.

Terms such as "processing," "computing," "calculating," or "determining" refer to operations carried out by computing systems or electronic devices, which manipulate data represented as physical (electronic) quantities within memory or registers.

Terms like "component," "system," and "module" refer to computer-related entities, whether hardware, software, or a combination thereof. One or more components may be described as "configured to," "configurable to," "operable/operative to," "adapted/adaptable to," or similar terms. Unless explicitly stated, these terms encompass components in both active and inactive states.

Unless stated otherwise, terms like "including" or "having" should be interpreted as open-ended (i.e., "including but not limited to"). Numeric claim recitations generally mean "at least" the stated number, and disjunctive terms like "A or B" should be interpreted to include either or both unless explicitly specified. Operations in any claim may generally be performed in any order unless explicitly stated. The recitation "at least one of A, B, and C" should be interpreted as any combination of A, B, and C, such A alone, B alone, C alone, A and B together, A and C together, B and C together, and/or A, B, and C together. The recitation "at least one of A, B, or C" should be interpreted to include A alone, B alone, C alone, A and B together, A and C together, B and C together, and/or A, B, and C together.

In summary, various embodiments have been described to illustrate the principles and applications of the disclosed systems and methods. These descriptions are not intended to limit the scope of the invention, and variations may be made by those skilled in the art. The accompanying claims define the invention's broadest legal scope within its spirit and scope.

What is claimed is:

1. A system for inferring status of switches positioned along a route traveled by a vehicle system, the system comprising:

a control circuit configured to:

associate a plurality of switches deployed sequentially along a route with a first switch indicator deployed along the route and located subsequent to or prior to the plurality of switches such that the first switch indicator is to emit:

a first signal in response to each of the plurality of switches being in its alignment configuration of aligning with the route; and a second signal in response to at least one of the plurality of switches being in its divergence configuration of diverging from the route;

cluster the first switch indicator that emits the first signal and the plurality of switches that each is in its alignment configuration into a first group;

cluster the first switch indicator that emits the second signal and the plurality of switches that one or more thereof is in its divergence configuration into a second group;

receive the first signal or the second signal emitted from the first switch indicator in response to the vehicle system traveling along the route in a first moving direction toward the first switch indicator and then the plurality of switches before arriving at a first outmost switch among the plurality of switches;

determine that each of the plurality of switches is in its alignment configuration based on the clustered first group in response to receiving the first signal;

determine that at least one switch among the plurality of switches is in its divergence configuration based on the clustered second group in response to receiving the second signal; and control movement of the vehicle system in response to a determination that the plurality of switches each is in its alignment configuration or that the at least one switch is in its divergence configuration.

2. The system of claim 1, wherein the control circuit is further configured to:

determine whether an upcoming switch among the plurality of switches is in its alignment configuration or its divergence configuration in response to a determination that the at least one switch among the plurality of switches is in its divergence configuration; and determine that a subsequent switch among the plurality of switches immediately after the upcoming switch in the first moving direction is in its divergence configuration in response to a determination that the upcoming switch is in its alignment configuration.

3. The system of claim 1, wherein the control circuit is further configured to:

determine whether an upcoming switch among the plurality of switches is in its alignment configuration or its divergence configuration in response to a determination that the at least one switch among the plurality of switches is in its divergence configuration; and determine that a subsequent switch among the plurality of switches after the upcoming switch in the first moving direction is in its divergence configuration in response to a determination that the upcoming switch is in its alignment configuration.

4. The system of claim 1, wherein the control circuit is further configured to:

embed the clustered first group and the clustered second group into data in a route database;

retrieve the data from the route database in response to receiving the first signal or the second signal;

determine that each of the plurality of switches is in its alignment configuration based on the clustered first group embedded in the retrieved data in response to receiving the first signal; and determine that the at least one switch among the plurality of switches is in its divergence configuration based on the clustered second group embedded in the retrieved data in response to receiving the second signal.

5. The system of claim 1, wherein the control circuit is further configured to:

determine that each of the plurality of switches is in its divergence configuration in response to a determination that the at least one switch among the plurality of switches is in its divergence configuration.

6. The system of claim 1, wherein the control circuit is further configured to:

receive the first signal or the second signal emitted from the first switch indicator by a signal receiving device mounted on the vehicle system or located at a control center separate from the vehicle system.

7. The system of claim 1, wherein the control circuit is further configured to:

selectively operate a switch among the plurality of switches to its alignment configuration for guiding the vehicle system to continue traveling along the route and to its divergence configuration for guiding the vehicle system to travel from the route to another route diverging from the route.

8. The system of claim 1, wherein the control circuit is further configured to:

associate a second switch indicator deployed along the route with the plurality of switches sandwiched in between the first switch indicator and the second switch indicator such that the second switch indicator is to emit:

a third signal in response to each of the plurality of switches being in its alignment configuration; and a fourth signal in response to the at least one switch being in its divergence configuration;

cluster the second switch indicator that emits the third signal and the plurality of switches that each is in its alignment configuration into a third group;

cluster the second switch indicator that emits the fourth signal and the plurality of switches that one or more thereof is in its divergence configuration into a fourth group;

receive the third signal or the fourth signal emitted from the second switch indicator in response to the vehicle system traveling along the route in a second moving direction opposite to the first moving direction toward the second switch indicator and then the plurality of switches before arriving at a second outmost switch among the plurality of switches opposite to the first outmost switch;

determine that each of the plurality of switches is in its alignment configuration based on the clustered third group in response to receiving the third signal; and determine that at least one switch among the plurality of switches is in its divergence configuration based on the clustered fourth group in response to receiving the fourth signal.

9. The system of claim 8, wherein the control circuit is further configured to:

determine whether an upcoming switch among the plurality of switches is in its alignment configuration or its divergence configuration in response to a determination that the at least one switch among the plurality of switches is in its divergence configuration; and determine that a subsequent switch among the plurality of switches immediately after the upcoming switch in the second moving direction is in its divergence configuration in response to a determination that the upcoming switch is in its alignment configuration.

10. The system of claim 8, wherein the control circuit is further configured to:

determine whether an upcoming switch among the plurality of switches is in its alignment configuration or its divergence configuration in response to a determination that the at least one switch among the plurality of switches is in its divergence configuration; and determine that a subsequent switch among the plurality of switches after the upcoming switch in the second moving direction is in its divergence configuration in response to a determination that the upcoming switch is in its alignment configuration.

11. The system of claim 8, wherein the control circuit is further configured to:

embed the clustered third group and the clustered fourth group into data in a route database;

retrieve the data from the route database in response to receiving the third signal or the fourth signal;

determine that each of the plurality of switches is in its alignment configuration based on the clustered third group embedded in the retrieved data in response to receiving the third signal; and determine that the at least one switch among the plurality of switches is in its divergence configuration based on the clustered fourth group embedded in the retrieved data in response to receiving the fourth indication signal.

12. The system of claim 8, wherein the control circuit is further configured to:

determine that each of the plurality of switches is in its divergence configuration in response to a determination that the at least one switch among the plurality of switches is in its divergence configuration.

13. The system of claim 8, wherein the control circuit is further configured to:

receive the third signal or the fourth signal emitted from the second switch indicator by a signal receiving device mounted on the vehicle system or located at a control center separate from the vehicle system.

14. The system of claim 8, wherein the control circuit is further configured to:

associate the first switch indicator and the second switch indicator with each other such that:

the second switch indicator is to emit the third signal in response to the first switch indicator emitting the first signal; and the second switch indicator is to emit the fourth signal in response to the first switch indicator emitting the second signal.

15. The system of claim 14, wherein the first signal and the third signal are emitted synchronously or asynchronously, and wherein the second signal and the fourth signal are emitted synchronously or asynchronously.

16. A method for inferring status of switches positioned along a route traveled by a vehicle system, the method comprising:

associating a plurality of switches deployed sequentially along a route with a first switch indicator deployed along the route and located subsequent to or prior to the plurality of switches such that the first switch indicator is to emit a first signal in response to each of the plurality of switches being in its alignment configuration of aligning with the route and a second signal in response to at least one switch among the plurality of switches being in its divergence configuration of diverging from the route;

clustering the first switch indicator that emits the first signal and the plurality of switches that each is in its alignment configuration into a first group;

clustering the first switch indicator that emits the second signal and the plurality of switches that one or more thereof is in its divergence configuration into a second group;

receiving the first signal or the second signal emitted from the first switch indicator in response to the vehicle system traveling along the route in a first moving direction toward the first switch indicator and then the plurality of switches before arriving at a first outmost switch among the plurality of switches;

determining that each of the plurality of switches is in its alignment configuration based on the clustered first group in response to receiving the first signal;

determining that at least one switch is in its divergence configuration based on the clustered second group in response to receiving the second signal; and controlling movement of the vehicle system in response to a determination that the plurality of switches each is in its alignment configuration or that the at least one switch is in its divergence configuration.

17. The method of claim 16, further comprising:

determining whether an upcoming switch among the plurality of switches is in its alignment configuration or its divergence configuration in response to a determination that the at least one switch among the plurality of switches is in its divergence configuration; and determining that a subsequent switch among the plurality of switches after the upcoming switch in the first moving direction is in its divergence configuration in response to a determination that the upcoming switch is in its alignment configuration.

18. The method of claim 16, further comprising:

associating a second switch indicator deployed along the route with the plurality of switches sandwiched in between the first switch indicator and the second switch indicator such that the second switch indicator is to emit a third signal in response to each of the plurality of switches being in its alignment configuration and a fourth signal in response to the at least one switch being in its divergence configuration;

clustering the second switch indicator that emits the third signal into the first group;

clustering the second switch indicator that emits the fourth signal into the second group;

receiving the third signal or the fourth signal emitted from the second switch indicator in response to the vehicle system traveling along the route in a second moving direction opposite to the first moving direction toward the second switch indicator and then the plurality of switches before arriving at a second outmost switch among the plurality of switches opposite to the first outmost switch;

determining that each of the plurality of switches is in its alignment configuration based on the clustered first group in response to receiving the third signal; and determining that the at least one switch is in its divergence configuration based on the clustered second group in response to receiving the fourth signal.

19. A system for inferring status of switches positioned along a route traveled by a vehicle system, the system comprising:

a control circuit configured to:

associate a plurality of switches deployed sequentially along a route with a first switch indicator deployed along the route and located subsequent to or prior to the plurality of switches such that the first switch indicator is to emit:

a first signal in response to each of the plurality of switches being in its alignment configuration of aligning with the route;

cluster the first switch indicator that emits the first signal and the plurality of switches that each is in its alignment configuration into a first group;

determine that each of the plurality of switches is in its alignment configuration based on the clustered first group in response to receiving the first signal emitted from the first switch indicator in response to the vehicle system traveling along the route in a moving direction toward the first switch indicator and then the plurality of switches before arriving at a first outmost switch among the plurality of switches; and control movement of the vehicle system in response to a determination that the plurality of switches each is in its alignment configuration.

20. The system of claim 19, wherein the control circuit is further configured to:

embed the clustered first group into data in a route database;

retrieve the data from the route database in response to receiving the first signal; and determine that each of the plurality of switches is in its alignment configuration based on the clustered first group embedded in the retrieved data in response to receiving the first signal.

21. The system of claim 19, wherein the control circuit is further configured to:

receive the first signal emitted from the first switch indicator by a signal receiving device mounted on the vehicle system or located at a control center separate from the vehicle system.

22. The system of claim 19, wherein the control circuit is further configured to:

selectively operate a switch among the plurality of switches to its alignment configuration for guiding the vehicle system to continue traveling along the route and to its divergence configuration of diverging from the route for guiding the vehicle system to travel from the route to another route diverging from the route.

23. The system of claim 19, wherein the control circuit is further configured to:

associate the plurality of switches with the first switch indicator such that the first switch indicator is to further emit:

a second signal in response to that at least one of the plurality of switches being in its non-correspondence configuration;

cluster the first switch indicator that emits the second signal and the plurality of switches that one or more thereof is in its non-correspondence configuration into a second group;

determine that at least one switch among the plurality of switches is in its non-correspondence configuration based on the clustered second group in response to receiving the second signal emitted from the first switch indicator in response to the vehicle system traveling along the route in the moving direction toward the first switch indicator and then the plurality of switches before arriving at the first outmost switch among the plurality of switches; and control movement of the vehicle system in response to a determination that the at least one switch is in its non-correspondence configuration.

24. The system of claim 23, wherein the control circuit is further configured to:

determine whether an upcoming switch among the plurality of switches is in its alignment configuration or its divergence configuration of diverging from the route in response to a determination that the at least one switch among the plurality of switches is in its non-correspondence configuration; and determine that a subsequent switch among the plurality of switches immediately after the upcoming switch in the moving direction is in its non-correspondence configuration in response to a determination that the upcoming switch is in its alignment configuration or its divergence configuration.

25. The system of claim 23, wherein the control circuit is further configured to:

determine whether an upcoming switch among the plurality of switches is in its alignment configuration or its divergence configuration of diverging from the route in response to a determination that the at least one switch among the plurality of switches is in its non-correspondence configuration; and determine that a subsequent switch among the plurality of switches after the upcoming switch in the moving direction is in its non-correspondence configuration in response to a determination that the upcoming switch is in its alignment configuration or its divergence configuration.

26. The system of claim 23, wherein the control circuit is further configured to:

embed clustered second group into data in a route database;

retrieve the data from the route database in response to receiving the second signal; and determine that the at least one switch among the plurality of switches is in its non-correspondence configuration based on the clustered second group embedded in the retrieved data in response to receiving the second signal.

27. The system of claim 23, wherein the control circuit is further configured to:

determine that each of the plurality of switches is in its alignment configuration, divergence configuration, or non-correspondence configuration in response to a determination that the at least one switch among the plurality of switches is in its non-correspondence configuration.

28. The system of claim 23, wherein the control circuit is further configured to:

receive the second signal emitted from the first switch indicator by a signal receiving device mounted on the vehicle system or located at a control center separate from the vehicle system.

29. The system of claim 23, wherein that the at least one of the plurality of switches is in its non-correspondence configuration indicates that the at least one of the plurality of switches is in its divergence configuration of diverging from the route, or that the at least one of the plurality of switches is in a configuration of which a status is unknown.

* * * * *